US008384274B2

(12) United States Patent
Camm et al.

(10) Patent No.: US 8,384,274 B2
(45) Date of Patent: Feb. 26, 2013

(54) HIGH-INTENSITY ELECTROMAGNETIC RADIATION APPARATUS AND METHODS

(75) Inventors: David Malcolm Camm, Vancouver (CA); Chee Chin, Maple Ridge (CA); Rick Doolan, Burnaby (CA); Tony Hewett, Richmond (CA); Arne Kjorvel, Vancouver (CA); Tony Komasa, Vancouver (CA); Mike Krasnich, Richmond (CA); Steve McCoy, Burnaby (CA); Joseph Reyers, Surrey (CA); Igor Rudic, Vancouver (CA); Ludmila Shepelev, Richmond (CA); Greg Stuart, Burnaby (CA); Tilman Thrum, Richmond (CA); Alex Viel, Vancouver (CA)

(73) Assignee: Mattson Technology, Inc., Freemont, CA (US)

( * ) Notice: Subject to any disclaimer, the term of this patent is extended or adjusted under 35 U.S.C. 154(b) by 0 days.

(21) Appl. No.: 12/835,589

(22) Filed: Jul. 13, 2010

(65) Prior Publication Data

US 2010/0276611 A1 Nov. 4, 2010

Related U.S. Application Data

(62) Division of application No. 10/777,995, filed on Feb. 12, 2004, now Pat. No. 7,781,947.

(51) Int. Cl.
*H01J 61/52* (2006.01)
*H01J 1/02* (2006.01)

(52) U.S. Cl. ..... 313/24; 313/22; 313/23; 313/35

(58) Field of Classification Search ..... 313/22–24, 313/17, 35, 41, 231.41, 231.51; 250/436, 250/493.1, 504 R; 118/723 R
See application file for complete search history.

(56) References Cited

U.S. PATENT DOCUMENTS

| | | | |
|---|---|---|---|
| 1,235,274 | A | 7/1917 | Wood |
| 1,610,124 | A | 12/1926 | Godley |
| 1,732,884 | A | 10/1929 | Foster |
| 1,737,027 | A | 11/1929 | Schoonmaker |

(Continued)

FOREIGN PATENT DOCUMENTS

| | | |
|---|---|---|
| CA | 1015817 | 8/1977 |
| CA | 1239437 | 7/1988 |

(Continued)

OTHER PUBLICATIONS

Atlas Electric Devices Company, "Specialists in Environmental and Material Testing," Bulletin 1650, Jul. 1992, pp. 1-8, Chicago, Illinois.

(Continued)

*Primary Examiner* — Bumsuk Won
(74) *Attorney, Agent, or Firm* — Knobbe, Martens, Olson & Bear, LLP

(57) ABSTRACT

An apparatus for producing electromagnetic radiation includes a flow generator configured to generate a flow of liquid along an inside surface of an envelope, first and second electrodes configured to generate an electrical arc within the envelope to produce the electromagnetic radiation, and an exhaust chamber extending outwardly beyond one of the electrodes, configured to accommodate a portion of the flow of liquid. In another aspect, the flow generator is electrically insulated. In another aspect, the electrodes are configured to generate an electrical discharge pulse to produce an irradiance flash, and the apparatus includes a removal device configured to remove particulate contamination from the liquid, the particulate contamination being released during the flash and being different than that released by the electrodes during continuous operation.

53 Claims, 14 Drawing Sheets

U.S. PATENT DOCUMENTS 1,759,720 A 5/1930 Stitzer
2,341,658 A 2/1944 Salani
2,877,341 A 3/1959 Edgerton
2,906,858 A 9/1959 Morton, Jr.
2,981,819 A 4/1961 Gregory
3,108,173 A 10/1963 Barrett et al.
3,188,459 A 6/1965 Bridwell
3,239,651 A 3/1966 Silberman
3,240,915 A 3/1966 Carter et al.
3,292,028 A 12/1966 Van Ornum
3,366,815 A 1/1968 Anderson
3,405,305 A 10/1968 Winzeler et al.
3,463,957 A 8/1969 Fuksiewicz
3,596,124 A 7/1971 Cleaver et al.
3,603,827 A 9/1971 Degawa et al.
3,612,933 A 10/1971 Troue
3,651,358 A * 3/1972 Troue ..... 313/12
3,739,215 A 6/1973 Murai
3,745,896 A 7/1973 Sperti et al.
3,816,784 A 6/1974 Weninger
3,983,436 A 9/1976 Schafer et al.
3,988,627 A * 10/1976 Dustmann et al. ..... 313/309
4,027,185 A 5/1977 Nodwell et al.
4,095,140 A 6/1978 Kirkhuff et al.
4,115,163 A 9/1978 Gorina et al.
4,151,008 A 4/1979 Kirkpatrick
4,325,006 A 4/1982 Morton
4,331,485 A 5/1982 Gat
4,370,175 A 1/1983 Levatter
4,398,094 A 8/1983 Hiramoto
4,417,300 A 11/1983 Bodmer
4,421,048 A 12/1983 Adema et al.
4,550,684 A 11/1985 Mahawili
4,567,352 A 1/1986 Mimura et al.
4,596,019 A 6/1986 Schmidt et al.
4,649,261 A 3/1987 Sheets
4,683,525 A 7/1987 Camm
4,698,486 A 10/1987 Sheets
4,700,102 A 10/1987 Camm et al.
4,794,230 A 12/1988 Seliskar et al.
4,877,997 A 10/1989 Fein
4,937,490 A 6/1990 Camm et al.
4,945,288 A 7/1990 Morris et al.
4,963,783 A 10/1990 Grossman
5,036,242 A 7/1991 Huber et al.
5,043,634 A 8/1991 Rothwell, Jr. et al.
5,046,145 A 9/1991 Drouet
5,076,051 A 12/1991 Naff
5,137,659 A 8/1992 Ashley et al.
5,138,520 A 8/1992 McMillan et al.
5,147,130 A 9/1992 Watanuki
5,168,194 A * 12/1992 Littlechild et al. ..... 313/632
5,219,786 A 6/1993 Noguchi
5,336,641 A 8/1994 Fair et al.
5,446,825 A 8/1995 Moslehi et al.
5,504,666 A 4/1996 Carmichael
5,561,735 A 10/1996 Camm
5,608,227 A 3/1997 Dierks et al.
5,727,017 A 3/1998 Maurer et al.
5,753,106 A 5/1998 Schenck
5,756,959 A 5/1998 Freeman et al.
5,777,437 A 7/1998 Neister
5,898,270 A 4/1999 Oiye et al.
5,900,211 A 5/1999 Dunn et al.
5,971,565 A 10/1999 Zapata et al.
6,066,516 A 5/2000 Miyasaka
6,156,995 A 12/2000 Severance, Jr.
6,214,034 B1 4/2001 Azar
6,252,203 B1 6/2001 Zapata et al.
6,293,696 B1 9/2001 Guardado
6,303,411 B1 10/2001 Camm et al.
6,417,625 B1 7/2002 Brooks et al.
6,465,799 B1 10/2002 Kimble et al.
6,534,752 B2 3/2003 Camm et al.
6,541,924 B1 * 4/2003 Kane et al. ..... 315/246
6,570,301 B1 5/2003 Hishinuma et al.
6,594,446 B2 7/2003 Camm et al.
6,608,967 B1 8/2003 Arrison
6,621,199 B1 9/2003 Parfeniuk et al.
6,849,831 B2 * 2/2005 Timans et al. ..... 219/390
6,858,987 B2 2/2005 Hiramoto
6,859,616 B2 2/2005 Kusuda et al.
6,885,815 B2 4/2005 Kusuda et al.
6,941,063 B2 9/2005 Camm et al.
6,960,883 B2 11/2005 Mizoziri et al.
6,963,692 B2 11/2005 Camm et al.
2002/0024290 A1 2/2002 Uemura et al.
2002/0102098 A1 8/2002 Camm et al.
2004/0105670 A1 6/2004 Kusuda et al.
2004/0178553 A1 9/2004 Camm et al.
2005/0062388 A1 3/2005 Camm et al.
2005/0063453 A1 3/2005 Camm et al.
2005/0133167 A1 6/2005 Camm et al.
2006/0096677 A1 5/2006 Camm et al.

FOREIGN PATENT DOCUMENTS

EP 0 102 931 3/1984
EP 0 105 230 3/1987
EP 0 404 406 12/1990
EP 0 841 685 5/1998
GB 1 468 137 3/1977
GB 2065973 7/1981
GB 2082745 3/1982
GB 2111186 6/1983
GB 2199693 8/1990
GB 2406725 4/2005
JP 55-067132 5/1980
JP 00 80729 5/1982
JP 57 197742 12/1982
JP 2 62036 3/1990
JP 2-78148 3/1990
JP 2 294027 12/1990
JP 6-53580 2/1994
JP 7 22194 1/1995
JP 10 504936 5/1998
JP 11-514277 12/1999
JP 2000-195469 7/2000
JP 2000-285866 10/2000
NO 32864 8/1921
WO WO 00/67298 11/2000
WO WO 01/54166 7/2001
WO WO 02/47123 6/2002
WO WO 02/47143 6/2002
WO WO 03/012824 2/2003
WO WO 03/060447 7/2003
WO WO 2004/057650 7/2004
WO WO 2005/059991 6/2005
WO WO 2005/078762 8/2005

OTHER PUBLICATIONS

Blake, et al. "Slip Free Rapid Thermal Processing," (1987), vol. 92. Mat. Res. Soc. Symp. Proc., pp. 265-272.

Bomke, et al. "Annealing of Ion-implanted Silicon by an Incoherent Light Pulse," Appl. Phys. Lett., vol. 33, No. 11, Dec. 1, 1978, pp. 955-957.

Brochure: "High Performance Flash and Arc Lamps," by PerkinElmer Optoelectronics, 39 pages, available at http://optoelectronics.perkinelmer.com/content/RelatedLinks/flashcatalog.pdf.

Burggraf, "Rapid Wafer Heating: Status 1983," Semiconductor International, Dec. 1983, pp. 69-74.

Camm, et al. "Engineering Ultra-shallow Junctions Using fRTP™" 10th IEEE International Conference on Advanced Thermal Processing of Semiconductors—RTP 2002, pp. 5-10.

Camm, et al. "High Power Arc Lamp RTP System for High Temperature Annealing Applications," 2nd International Rapid Thermal Conference, 1994, pp. 1-7.

Camm, et al. "Spike Thermal Processing Using Arc Lamps," Advances in Rapid Thermal Processing, 2000.

Cibere, et al. "Flash Thermal Processing Through the Melting Point of Silicon," 11th IEEE International Conference on Advanced Thermal Processing of Semiconductors—RTP 2003.

Cohen, et al. "Thermally Assisted Flash Annealing of Silicon and Germanium," Appl. Phys. Lett., vol. 33, No. 8, Oct. 15, 1978, pp. 751-753.

da Silva, et al. "Automated Test System for NIF Flashlamps," Pulse Power Plasma Science 2001 Conference, Las Vegas, Nevada, Jun. 17-22, 2001.
DSI Industrial Lighting Products web site, ttp://www.heatbuster.com/, Nov. 29, 1999, various pages including http://www.heatbuster.com/Prod_Cold_Mirror.htm, http://heatbuster.com/Prod_Hot_Mirror.htm, http://www.heatbuster.com/Prod_High_Temp_Cold.htm, http://www.heatbuster.com/Technical.html.
Electric Devices Company, "Xenon Arc Light Systems," Bulletin 1183, pp. 1-4, Chicago, Illinois.
Fiory, et al. "Annealing Ultra-Low Energy Boron Implants with an Arc Lamp System," RTP 1999, 1999, pp. 273-280.
Fiory, et al. "Electrical measurements of Annealed Boron Implants for Shallow Junctions," Advances in Rapid Thermal Processing, vol. 99-10, 1999, pp. 133-140.
Fiory, et al. "Spike Annealing of Implanted PMOS Gates," Proc. of RTP 2000 Conference, Sep. 20-22, 2000, pp. 1-8.
Gelpey, et al. "Process Control for a Rapid Optical Annealing System" Mat. Res. Soc. Symp. Proc., Materials Res. Soc., vol. 82, 1986.
Gelpey, et al. "Rapid Optical Annealing Using the Water-Wall DC Arc Lamp," Microelectronic Manufacturing and Testing, Aug. 1983, pp. 22-24.
Gelpey, et al. "Advanced Annealing for Sub-130mm Junction Formation," 201$^{st}$ Electrochemical Society Meeting Symposium Q1, Rapid Thermal and Other Short-Time Processing Technologies III, May 12-17, 2002, paper 735 (May 2002).
Klabes, et al. "Pulsed Incoherent Light Annealing of Arsenic and Phosphorous Implanted Polycrystalline Silicon," physica status solidi, 1982, pp. K5-7, K9-12.
Lefrancois, et al. "Temperature Uniformity During Impulse™ Anneal," 8$^{th}$ International Conference on Advanced Thermal Processing of Semiconductors, RTP 2000, Sep. 20-22, 2000, pp. 1-6.
Lietoila, et al. "Temperature Rise Induced in Si by Continuous Xenon Arc Lamp Radiation," J. Appl. Phys., vol. 53, No. 2, Feb. 1982, pp. 1169-1172.
Lue, "Arc Annealing of BF+2 Implanted Silicon by a Short Pulse Flash Lamp," Appl. Phys. Lett., vol. 36, No. 1, Jan. 1, 1980.
Lunde, "Nasa Tech Brief," B75-1008, Lewis Research Center, Apr. 1975.
Powell, et all. "Activation of Arsenic Implanted Silicon Using an Incoherent Light Source," Appl. Phys. Lett., vol. 39, No. 2, Jul. 15, 1981, pp. 150-152.
Powell, et al. "Annealing of Implantation Damage in Integrated-Circuit Devices Using an Incoherent Light Source," J. Vac. Sci. Technol., vol. 20, No. 1, Jan. 1982, pp. 32-36.
Products, Capabilities, Tamarack Scientific Co., Inc.
Ross, et al. "Characterizing Implant Behavior during Flash RTP by Means of Backside Diagnostics," 10$^{th}$ IEEE International Conference on Advanced Thermal Processing of Semiconductors—RTP 2002, pp. 99-105.
Searchlight Model-100, Tamarack Scientific Co., Inc.
Sedgwick, "Short Time Annealing," J. Electrochem. Soc., vol. 130, No. 2, Feb. 1983, pp. 484-492.
Stuart, et al. "Temperature Diagnostics for a Dual-ARC fRTP Tool," 10$^{th}$ IEEE International Conference on Advanced Thermal Processing of Semiconductors—RTP 2002, pp. 77-82.
Technical Information from Heraeus Noblelight, available at http://www.nobellight.net.
Tichy, et al. Annealing of Ultra-Shallow Implanted Junctions Using Arc-Lamp Technology: Achieving the 90 nm Node, 9$^{th}$ IEEE International Conference on Advanced Thermal Processing of Semiconductors—RTP 2001 (Sep. 2001).
Transient Calorimeter Calibration System AFFDL-TR-75-24, Tamarack Scientific Company, Orange, California, Mar. 1975, pp. 1-50.
Wilson, et al. "An Overview and Comparison of Rapid Thermal Processing Equipment: A Users Viewpoint," (1986), vol. 52, Mat. Res. Soc. Symp. Proc., pp. 181-190.
Paint Booth Technologies, "Exhaust Chambers", published at http://www.paintboothtechnologies.com/pdfs/ExhaustChamber.pdf, as of Aug. 2, 2011.
Col-Met Spray Booths, "EZ Exhaust Chambers", published at www.colmetsb.com/products/industrial-finishing/ez-exhaust-chambers, as of Aug. 2, 2011.
Spray Booth Supplies.com, "Wood Finishing Exhaust Chambers" published at www.sprayboothsupplies.com/wood-finishing-industrial-exhaust-chamber/, as of Aug. 2, 2011.
Nakamura, et al. "Extension of the Life of a Flashlamp Pumped Ti:Sapphire Laser," *Review of Laser Engineering*, vol. 24, No. 2, pp. 235-243, 1996.

* cited by examiner

HIGH-INTENSITY ELECTROMAGNETIC RADIATION APPARATUS AND METHODS

CROSS-REFERENCE TO RELATED APPLICATION

This application is a division of U.S. patent application Ser. No. 10/777,995 filed Feb. 12, 2004, which is hereby incorporated herein by reference.

BACKGROUND OF THE INVENTION

1. Field of Invention

The present invention relates to irradiance, and more particularly to methods and apparatus for producing electromagnetic radiation.

2. Description of Related Art

Arc lamps have been used to produce electromagnetic radiation for a wide variety of purposes. Generally, arc lamps include continuous or DC arc lamps for producing continuous irradiance, as well as flashlamps for producing irradiance flashes.

Continuous or DC arc lamps have been used for applications ranging from sunlight simulation to rapid thermal processing of semiconductor wafers. A typical conventional DC arc lamp includes two electrodes, namely, a cathode and an anode, mounted within a quartz envelope filled with an inert gas such as xenon or argon. An electrical power supply is used to sustain a continuous plasma arc between the electrodes. Within the plasma arc, the plasma is heated by the high electrical current to a high temperature via particle collision, and emits electromagnetic radiation, at an intensity corresponding to the electrical current flowing between the electrodes.

Flashlamps are similar in some ways to continuous arc lamps, but differ in other respects. Rather than using a constant electrical current to produce a continuous radiant output, a capacitor bank or other pulsed power supply is abruptly discharged through the electrodes, to generate a high-energy electrical discharge pulse in the form of a plasma arc between the electrodes. As with continuous arc lamps, the plasma is heated by the large electrical current of the discharge pulse, and emits light energy in the form of an abrupt flash whose duration corresponds to that of the electrical discharge pulse. For example, some flashes may be on the order of one millisecond in duration, although other durations may also be achieved. Unlike continuous arc lamps, which typically operate under quasi-static pressure and temperature conditions, flashlamps are typically characterized by large, abrupt changes in pressure and temperature during the flash.

Historically, one of the major applications of high power flashlamps has been laser pumping. As a more recent example, a high power flashlamp has been used to anneal a semiconductor wafer, by irradiating a surface of the wafer at a power on the order of five megawatts, for a pulse duration on the order of one millisecond.

Cooling of conventional flashlamps typically consists of cooling only the outside surface of the envelope, rather than the inside surface. Although simple convection cooling using ambient air is sufficient for low-power applications, high-power applications often require the outside of the envelope to be cooled by forced air or other gas, or by water or another liquid for even higher-power applications.

Such conventional high-power flashlamps tend to suffer from a number of difficulties and disadvantages. One factor that tends to limit the lifetime of such lamps is the mechanical strength of the quartz envelopes, which are typically on the order of 1 mm thick, and rarely exceed 2.5 mm in thickness. In this regard, although increasing the thickness of the quartz envelope increases its mechanical strength, the additional quartz material provides added insulation between the cooled outer surface of the envelope and the inner surface of the envelope, which is heated by the plasma arc. Therefore, with thicker tubes, it is more difficult for the outer coolant to remove heat from the inner surface of the envelope. As a result, the inner surface of a thicker envelope is heated to higher temperatures, resulting in greater thermal gradients in the envelope which tend to cause thermal stress cracks, ultimately leading to envelope failure. Thus, the thickness of an envelope, and hence its mechanical strength, are limited in conventional flashlamps. This in turn limits the ability of the envelope to withstand the mechanical stresses resulting from the significant rapid changes in gas pressure within the envelope resulting from the rapid increases of arc temperature and diameter during the flash.

A further difficulty with conventional lamps involves ablation of the quartz envelope, primarily from evaporation of quartz material from the heated inner surface of the envelope. Such ablation tends to contaminate the arc gas with oxygen. As most commercially-available arc lamps are sealed systems rather than recirculating, the accumulation of such contaminants in the arc gas tends to cause the radiant output of the lamp to drop over time. Such changes in the radiant output of the flashlamp may be undesirable for many applications, such as semiconductor annealing, in which reproducibility is strongly desired. The accumulation of these contaminants also tends to make the lamp more difficult to start.

Yet another disadvantage of conventional flashlamps results from sputtering of material from the electrodes, which are typically made of tungsten or tungsten alloys. In this regard, the abrupt emission of electrons and the resulting arc can sputter or blast off significant amounts of material from the cathode. To a lesser extent, the abrupt electron bombardment and the heat of the arc can cause partial melting of the anode tip, also resulting in the release of anode material. As a result, sputtering deposits tend to accumulate on the inside surface of the envelope, thereby reducing the radiant output of the lamp, as well as causing its radiation pattern to become increasingly non-uniform over time. In addition, such deposits on the inside surface of the envelope tend to be heated by the flash, thereby increasing local thermal stress in the envelope, which may eventually lead to cracking and failure of the envelope. Such loss of material also reduces electrode lifetimes.

A further disadvantage of conventional flashlamps is the relatively poor reproducibility of the radiant emissions of the arc itself. Some conventional lamps maintain a low-current continuous DC discharge between the electrodes, referred to as an idle current or simmer current, in between flashes. The purpose of the simmer current in conventional lamps is primarily to heat the cathode sufficiently to begin emitting electrons, which reduces sputtering and thereby increases lamp lifetime, although the simmer current may also provide at least some pre-ionization of the gas. The simmer current is typically less than one amp, and generally cannot be significantly increased in conventional flashlamps without causing overheating of the electrodes and sputtering. As a result, the present inventors have observed that the large change in the arc current that occurs in the transition from the simmer current to the peak flash current tends to occur in a relatively inconsistent manner in conventional flashlamps, resulting in poor reproducibility characteristics of the flash.

Accordingly, there is a need for an improved flashlamp and method.

SUMMARY OF THE INVENTION

In addressing the above need, the present inventors have investigated modifications of continuous or DC arc lamps in which the inside surface of the envelope is cooled by a vortexing flow of liquid, such as those disclosed in commonly-owned U.S. Pat. Nos. 6,621,199, 4,937,490 and 4,700,102, and earlier U.S. Pat. No. 4,027,185, for example, the complete disclosures of which are incorporated herein by reference. Although one of the present inventors has previously described a modified use of such a water-wall continuous arc lamp in conjunction with a pulsed power supply to act as a flashlamp, in general, such water-wall arc lamps have typically been considered to be undesirable for flashlamp applications. In this regard, the very large increases in arc temperature and diameter during a flash can potentially have dramatic effects on the liquid and gas flows within the envelope. The large and abrupt increase in pressure within the envelope can be further compounded if the internal cooling liquid boils and produces steam, thereby further increasing the pressure, potentially leading to envelope failure.

This same abrupt increase in pressure can cause the vortexing liquid wall to be pushed against the inside surface of the envelope, thereby forcing the liquid axially outward in opposite directions away from the center of the lamp, toward and past the electrodes. This can result in an abrupt backsplash of liquid onto the electrodes, potentially extinguishing the arc, and also potentially detracting from electrode lifespan.

In addition, to the extent that this pressure increase forces liquid back toward the cathode, the back-pressure in this direction opposes the pump pressure, and may potentially weaken the mechanical connections of the vortexing liquid flow generator components.

In addition, the present inventors have discovered that the operation of such a water-wall arc lamp as a flashlamp tends to produce different particulate contamination than that which results from operation of the same type of lamp in continuous or DC mode. In particular, the present inventors have discovered that tungsten particles as small as 0.5 to 2 microns tend to be released by the electrodes in flash-mode, whereas the particulate contamination resulting from operation of the same lamp in continuous or DC mode typically consists of particles no smaller than 5 microns. Existing water-wall arc lamp filtration systems are typically inadequate to remove the smaller particulate contamination resulting particularly from flash-mode operation. The present inventors have appreciated that the accumulation of such small particulate contamination in the liquid coolant tends to alter the output power and spectrum of the lamp over time, thereby undesirably detracting from the reproducibility of the flashes produced by the lamp.

The present inventors have further appreciated that for some ultra-high-power applications, it would be desirable to employ a plurality of flashlamps in close proximity to each other, to allow such lamps to simultaneously or contemporaneously flash together. However, typical existing water-wall arc lamps have uninsulated metal flow generator components mounted outside the radial distance of the envelope. In addition to their conductivity, the metal flow generator components are typically used as an electrical connection to the cathode, to effectively connect the cathode to the negative terminal of the capacitor bank or other pulsed power supply. Thus, during the flash, the flow generator components are at the same negative potential as the cathode. Thus, conductive components of each lamp, such as its grounded reflector for example, must be maintained sufficiently far away from the flow generator of each adjacent lamp to prevent arcing through the ambient air from the flow generator of one lamp to the grounded reflector or other conductive components of an adjacent lamp. This tends to impose an undesirably large minimum spacing between adjacent lamps.

In accordance with one aspect of the invention, there is provided an apparatus for producing electromagnetic radiation. The apparatus includes a flow generator configured to generate a flow of liquid along an inside surface of an envelope, and first and second electrodes configured to generate an electrical arc within the envelope to produce the electromagnetic radiation. The apparatus further includes an exhaust chamber extending outwardly beyond one of the electrodes, configured to accommodate a portion of the flow of liquid.

Such an exhaust chamber has been found to be advantageous for both flashlamp and continuous arc lamp applications. In this regard, the presence of the exhaust chamber tends to increase the distance between the arc and the location at which the flow of liquid begins to collapse. Thus, the exhaust chamber tends to reduce the effect on the arc of turbulence resulting from the collapse of the flow of liquid, thereby improving the stability of the arc. Accordingly, the exhaust chamber tends to improve the stability and reproducibility of the radiant output of the arc lamp, for both continuous and flashlamp applications.

The flow of liquid along the inside surface of the envelope is also advantageous. For example, this flow of liquid significantly reduces the thermal gradient between the inside and outside surfaces of the envelope, thereby reducing thermal stress on the envelope, which is advantageous for both continuous and flashlamp applications. This in turn allows thicker envelopes to be used than in conventional flashlamps, thereby allowing envelopes having greater mechanical strength to be used, to more easily withstand the abrupt pressure increase during the flash. In turn, increasing the thickness of the envelopes allows larger diameter tubes to be employed, thereby allowing for larger and more powerful arcs, without exceeding stress tolerances of the envelopes. The flow of liquid along the inside surface of the envelope also inhibits or prevents ablation of the inside surface of the envelope during the flash, or during continuous operation. In addition, this flow of liquid also reduces problems caused by electrode sputtering, as any sputtered material tends to be swept out of the envelope by the flow of liquid, rather than accumulating on the inside surface as in conventional flashlamps. Thus, the irradiance flashes or continuous irradiance outputs produced by such an apparatus tend to be more reproducible and consistent over time than those produced by conventional flashlamps or continuous arc lamps, respectively.

The exhaust chamber may extend axially outwardly sufficiently far beyond the one of the electrodes to isolate the one of the electrodes from turbulence resulting from collapse of the flow of liquid within the exhaust chamber.

The flow generator may be configured to generate a flow of gas radially inward from the flow of liquid, in which case the exhaust chamber may extend sufficiently far beyond the one of the electrodes to isolate the one of the electrodes from turbulence resulting from mixture of the flows of liquid and gas.

The electrodes may be configured to generate an electrical discharge pulse to produce an irradiance flash, in which case the exhaust chamber preferably has a sufficient volume to accommodate a volume of the liquid forced outward by a pressure pulse resulting from the electrical discharge pulse. Such an exhaust chamber is particularly advantageous for flashlamp applications, as it increases the effective internal volume of the apparatus, and thereby assists in reducing the peak internal pressure that results from the flash and any associated boiling and steam generation that may occur. Thus, mechanical stress on the envelope and other components is reduced. In addition, such an exhaust chamber allows water forced axially outwardly by the increased pressure of the flash to continue flowing past the electrode, thereby reducing the tendency of such water to back-splash onto the electrode. By reducing the likelihood of liquid splashing onto the electrodes, the exhaust chamber tends to increase electrode life-span and reduce the likelihood of the arc being quenched or extinguished.

The second electrode may include an anode, and the exhaust chamber may extend axially outwardly beyond the anode.

The flow generator may be electrically insulated. For example, the apparatus may include electrical insulation surrounding the flow generator, and the flow generator may include a conductor. Electrical insulation of the flow generator allows for safer operation of the apparatus without fear of arcing between the flow generator and external conductors, and allows for closer spacing of adjacent lamps in a multi-lamp system. The availability of a conductor as the flow generator is advantageous as it allows the flow generator to benefit from the mechanical strength of metal to withstand the liquid flow pressure and back-pressure during a flash, and also allows the flow generator to act as an electrical connector to connect the cathode to a power supply.

The first electrode may include a cathode, and the electrical insulation may surround the cathode and an electrical connection thereto. Such embodiments tend to further enhance the safety of single-lamp systems and reduce the minimum spacing between adjacent lamps in multi-lamp systems.

The apparatus may further include the electrical connection, which in turn may include the flow generator. Thus, the flow generator itself may advantageously act as part of the electrical connection between the cathode and a negative terminal of a capacitor bank or other pulsed power supply.

The electrical insulation surrounding the flow generator may include the envelope. The electrical insulation surrounding the flow generator may further include an insulative housing. In such an embodiment, the insulative housing may surround at least a portion of the envelope.

Advantageously, including the flow generator within the envelope and the insulative housing allows the flow generator to be disposed in close proximity to the axis of the apparatus, which in turn allows for stronger threaded and bolted mechanical connections than previous water-wall arc lamps having flow generator components outside the envelope. This in turn assists the flow generator in withstanding the mechanical stress of the flash, which tends to force some of the liquid axially outwards opposing the direction of the flow generator.

The electrical insulation may further include compressed gas in a space between the insulative housing and the portion of the envelope.

The envelope may include a transparent cylindrical tube. The tube may have a thickness of at least four millimeters. In this regard, the flow of liquid on the inner surface of the envelope reduces thermal gradients in the envelope, and therefore allows for thicker tubes than those used in conventional flashlamps, thereby providing the envelope with greater mechanical strength to withstand the large abrupt increase in pressure during a flash.

The tube may include a precision bore cylindrical tube, which tends to improve the effectiveness of seals engaged with the envelope, and also tends to improve the performance of the flow of liquid along the inner surface of the envelope.

The insulative housing may include at least one of a plastic and a ceramic.

The first and second electrodes may include a cathode and an anode, and the cathode may have a shorter length than the anode. In this regard, a shortened cathode tends to have greater mechanical strength, which is advantageous to prevent cathode vibration for continuous arc lamp applications, and which is advantageous to withstand the abrupt pressure changes and stresses during a flash.

The first electrode may include a cathode having a protrusion length along which it protrudes axially inwardly within the envelope toward a center of the apparatus beyond a next-most-inner component of the apparatus within the envelope. The protrusion length may be less than double a diameter of the cathode. Thus, the cathode may be shorter relative to its thickness than typical conventional cathodes, thereby improving its mechanical strength, and providing it with greater ability to resist vibration in continuous operation, or abrupt pressure changes and stresses during a flash.

Conversely, however, the protrusion length is preferably sufficiently long to prevent the electrical arc from occurring between the flow generator and the second electrode. Such a length is preferable for embodiments in which the flow generator is a conductor and forms part of the electrical connection between the cathode and the pulsed power supply, as the flow generator is at the same electrical potential as the cathode in such embodiments. It is therefore desirable in such embodiments to ensure that the cathode is sufficiently long to prevent the arc from being established between the anode and the flow generator rather than the anode and the cathode.

In accordance with another aspect of the invention, there is provided a system including a plurality of apparatuses as described above, configured to irradiate a common target. For example, the plurality of apparatuses may be configured to irradiate a semiconductor wafer.

The plurality of apparatuses may be configured parallel to each other. If so, each one of the plurality of apparatuses is preferably aligned in a direction opposite to an adjacent one of the plurality of apparatuses, such that a cathode of the each one of the plurality of apparatuses is adjacent an anode of the adjacent one of the plurality of apparatuses. Thus, whether in continuous or flash operation, the strong magnetic fields produced by the plasma arcs tend to cancel each other, particularly where there are an even number of apparatuses so aligned.

The system may further include a single circulation device configured to supply liquid to the flow generator of each of the plurality of apparatuses. In such embodiments, a more efficient system is provided, by eliminating the need for independent circulation devices for each apparatus.

The apparatus may further include a conductive reflector outside the envelope and extending from a vicinity of the first electrode to a vicinity of the second electrode.

The apparatus may further include a plurality of power supply circuits in electrical communication with the electrodes. If so, the apparatus preferably includes an isolator configured to isolate at least one of the plurality of power supply circuits from at least one other of the plurality of power supply circuits.

Each of the electrodes may include a coolant channel for receiving a flow of coolant therethrough. In addition, at least one of the electrodes may include a tungsten tip having a thickness of at least one centimeter.

Advantageously, such electrodes tend to have longer life-spans than conventional electrodes, especially for flash applications, although also for continuous operation. In this regard, liquid-cooling tends to reduce the tendency of the electrode to melt, sputter or otherwise release material, although during the flash itself, particularly fast flashes on the order of one millisecond or shorter in duration, the heating of the electrode surface tends to occur more quickly than the coolant can remove heat from the electrode via the coolant channel. During the flash, the greater thickness of the electrode tip as compared with conventional electrodes provides the electrode tip with greater heat capacity, which tends to mitigate the heating effects of the flash and thereby reduce the rate at which the tip tends to melt, sputter or otherwise lose material. To the extent that the electrode may still lose material at a diminished rate, the thicker tip provides more material for the electrode to be able to lose, thereby further extending the life-span of the electrode. The flow of liquid along the inner surface of the envelope removes such molten or otherwise lost material from the system, rather than allowing it to accumulate on the inner surface of the envelope, thereby extending envelope life and preserving the consistency and reproducibility of the spectrum and power of the radiant output of the apparatus.

The electrodes may be configured to generate an electrical discharge pulse to produce an irradiance flash, and the apparatus may further include an idle current circuit configured to generate an idle current between the first and second electrodes. The idle current circuit may be configured to generate the idle current for a time period preceding the electrical discharge pulse, the time period being longer than a fluid transit time required by the flow of liquid to travel through the envelope. For example, in an embodiment in which the flow of liquid traverses the envelope in about thirty milliseconds, the idle current circuit may be configured to generate the idle current for at least about thirty milliseconds.

The idle current circuit may be configured to generate, as the idle current, a current of at least about $1\times10^2$ amps. In this regard, the coolant channels in the electrodes allow a much higher idle or simmer current than conventional flashlamps, without the severe melting or sputtering that would tend to result if conventional electrodes were subjected to such a high idle current. The present inventors have found that the higher idle current provides more consistent, well-defined starting conditions for the flash. More particularly, the higher idle current serves to define a hot, wide ionized channel between the electrodes, ready to receive the electrical discharge pulse. Effectively, the higher idle current serves to reduce the initial resistance between the electrodes immediately prior to the flash (although the peak impedance during the flash itself may remain largely unchanged). The present inventors have found that this advantageously results in greater consistency and reproducibility of flashes produced by the apparatus, and also tends to reduce loss of electrode material, thereby resulting in longer electrode life.

The idle current circuit may be configured to generate, as the idle current, a current of at least about $4\times10^2$ amps, for at least about $1\times10^2$ milliseconds.

In accordance with another aspect of the invention, there is provided an apparatus for producing electromagnetic radiation. The apparatus includes means for generating a flow of liquid along an inside surface of an envelope, and further includes means for generating an electrical arc within the envelope to produce the electromagnetic radiation. The apparatus also includes means for accommodating a portion of the flow of liquid, the means for accommodating extending outwardly beyond the means for generating.

In accordance with another aspect of the invention, there is provided a method of producing electromagnetic radiation. The method includes generating a flow of liquid along an inside surface of an envelope, and generating an electrical arc within the envelope between first and second electrodes to produce the electromagnetic radiation. The method further includes accommodating a portion of the flow of liquid in an exhaust chamber extending outwardly beyond one of the electrodes.

Accommodating may include isolating the one of the electrodes from turbulence resulting from collapse of the flow of liquid within the exhaust chamber.

The method may further include generating a flow of gas radially inward from the flow of liquid, and accommodating may include isolating the one of the electrodes from turbulence resulting from collapse of the flows of liquid and gas.

Generating an electrical arc may include generating an electrical discharge pulse to produce an irradiance flash, and accommodating may include accommodating a volume of the liquid forced outward by a pressure pulse resulting from the electrical discharge pulse.

Generating the flow of liquid may include generating the flow of liquid using an electrically insulated flow generator.

In accordance with another aspect of the invention, there is provided a method including controlling a plurality of apparatuses as described herein to irradiate a common target, such as a semiconductor wafer, for example.

Controlling may include causing each one of the plurality of apparatuses to generate the electrical arc in a direction opposite to that of an electrical arc direction in each adjacent one of the plurality of apparatuses.

The method may further include isolating at least one of a plurality of power supply circuits from at least one other of the plurality of power supply circuits.

The method may further include cooling the first and second electrodes. Cooling may include circulating liquid coolant through respective coolant channels of the first and second electrodes.

Generating the electrical arc may include generating an electrical discharge pulse to produce an irradiance flash, and the method may further include generating an idle current between the first and second electrodes. Generating the idle current may include generating the idle current for a time period preceding the electrical discharge pulse, the time period being longer than a fluid transit time required by the flow of liquid to travel through the envelope. This may include generating, as the idle current, a current of at least about $1\times10^2$ amps. More particularly, this may include generating, as the idle current, a current of at least about $4\times10^2$ amps, for at least about $1\times10^2$ milliseconds.

In accordance with another aspect of the invention, there is provided an apparatus for producing electromagnetic radiation. The apparatus includes an electrically insulated flow generator configured to generate a flow of liquid along an inside surface of an envelope. The apparatus further includes first and second electrodes configured to generate an electrical arc within the envelope to produce the electromagnetic radiation.

Advantageously, as discussed above, the flow of liquid reduces thermal stress in the envelope, allows thicker envelopes to be used, inhibits or prevents ablation of the envelope, and reduces problems caused by electrode sputtering. Thus, the irradiance output of such an apparatus, whether for a flashlamp or continuous irradiance application, tends to be more consistent and reproducible over time than in conventional lamps. At the same time, the fact that the flow generator is electrically insulated allows for safer operation of the apparatus without fear of arcing between the flow generator and external conductors, and allows for closer spacing of adjacent lamps in a multi-lamp system.

The apparatus preferably includes electrical insulation surrounding the flow generator. Thus, the flow generator may include a conductor, if desired, in which case the flow generator is still electrically insulated by the electrical insulation. Advantageously, as discussed above, the availability of a conductor as the flow generator allows the flow generator to benefit from the mechanical strength of metal to withstand the liquid flow pressure and back-pressure during the flash, and also allows the flow generator to act as an electrical connector to connect the cathode to a power supply.

In a preferred embodiment, the first electrode includes a cathode, and the electrical insulation surrounds the cathode and an electrical connection thereto. Such embodiments tend to further enhance the safety of single-lamp systems and reduce the minimum spacing between adjacent lamps in multi-lamp systems.

The apparatus may further include the electrical connection, which in turn may include the flow generator. Thus, the flow generator itself may advantageously act as part of the electrical connection between the cathode and a negative terminal of a capacitor bank or other pulsed power supply.

The electrical insulation surrounding the flow generator may include the envelope.

The electrical insulation surrounding the flow generator may further include an insulative housing. In such an embodiment, the insulative housing may surround at least a portion of the envelope.

Advantageously, as discussed above, including the flow generator within the envelope and the insulative housing allows the flow generator to be disposed in close proximity to the axis of the apparatus, which in turn allows for stronger mechanical connections, thereby assisting the flow generator in withstanding the mechanical stress of the flash.

The electrical insulation may further include gas in a space between the insulative housing and the portion of the envelope. The gas may include an insulating gas such as nitrogen, for example. In such an embodiment, the apparatus may further include a pair of spaced apart seals cooperating with an inner surface of the insulative housing and an outer surface of the portion of the envelope to seal the gas in the space. The gas is preferably compressed, above atmospheric pressure.

The envelope may include a transparent cylindrical tube.

The tube may have a thickness of at least four millimeters. More particularly, the tube may have a thickness of at least five millimeters. As noted above, the flow of liquid reduces thermal gradients in the envelope, and therefore allows for thicker tubes with commensurately greater mechanical strength than those used in conventional flashlamps, thereby providing the envelope with greater ability to withstand the large abrupt increase in pressure during the flash.

The tube may include a precision bore cylindrical tube. If so, the precision bore cylindrical tube may have a dimensional tolerance at least as low as $5\times10^{-2}$ millimeters. As noted, the use of such a precision bore improves the effectiveness of seals engaged with the envelope, and also improves the performance of the flow of liquid along the inner surface of the envelope.

The tube may include quartz. For example, the tube may include pure quartz, such as synthetic quartz. Alternatively, the tube may include cerium-doped quartz, for example. The use of either pure quartz or cerium-doped quartz is desirable, as these materials tend to be free from the effects of solarization (a discoloration of the quartz resulting from UV absorption by ion impurities in the quartz; pure quartz lacks such impurities, while cerium-oxide dopants absorb the harmful UV and re-emit the energy as visible fluorescence before it can be absorbed by other impurities in the quartz). Such embodiments are particularly advantageous for applications in which a constant, reproducible flash spectrum over time is desirable, such as semiconductor annealing applications, for example.

Alternatively, the tube may include sapphire. Alternatively, other suitable transparent materials may be substituted.

The apparatus insulative housing may include at least one of a plastic and a ceramic. For example, the insulative housing may include ULTEM™ plastic.

The first and second electrodes may include a cathode and an anode, and the cathode may have a shorter length than the anode. In this regard, a shortened cathode tends to have greater mechanical strength to withstand the abrupt pressure changes and stresses during the flash.

The first electrode may include a cathode having a protrusion length along which it protrudes axially inwardly within the envelope toward a center of the apparatus beyond a next-most-inner component of the apparatus within the envelope.

The protrusion length may be less than double a diameter of the cathode. Thus, the cathode may be shorter relative to its thickness than typical conventional cathodes, thereby improving its mechanical strength.

Conversely, however, the protrusion length is preferably sufficiently long to prevent the electrical arc from occurring between the flow generator and the second electrode. Such a length is preferable for embodiments in which the flow generator is a conductor and forms part of the electrical connection between the cathode and the pulsed power supply, as the flow generator is at the same electrical potential as the cathode in such embodiments. It is therefore desirable in such embodiments to ensure that the cathode is sufficiently long to prevent the arc from being established between the anode and the flow generator rather than the anode and the cathode.

The protrusion length may be at least three and a half centimeters.

The flow generator may include the next-most-inner component. The protrusion length of the cathode beyond the flow generator may be less than five centimeters.

In accordance with another aspect of the invention, there is provided a system including a plurality of apparatuses as described herein, configured to irradiate a common target. The common target may include a semiconductor wafer.

The plurality of apparatuses may be configured parallel to each other. If so, each one of the plurality of apparatuses is preferably aligned in a direction opposite to an adjacent one of the plurality of apparatuses. Thus, a cathode of each one of the plurality of apparatuses may be adjacent an anode of an adjacent one of the plurality of apparatuses. Advantageously, as noted above, the strong magnetic fields produced by the plasma arcs tend to cancel each other, particularly where there is an even number of apparatuses so aligned.

An axial line between the first and second electrodes of each one of the plurality of apparatuses may be spaced apart less than $1\times10^{-1}$ meters from an axial line between the first and second electrodes of an adjacent one of the plurality of apparatuses. Such close-proximity spacing, which is facilitated by the fact that the flow generator is electrically insulated, allows a larger number of lamps to be positioned side-by-side in a single multi-lamp system.

The system may further include a single circulation device configured to supply liquid to the flow generator of each of the plurality of apparatuses. If so, the single circulation device may be configured to receive liquid and gas from an exhaust port of each of the plurality of apparatuses. The single circulation device may include a separator configured to separate the liquid from the gas, and may include a filter for removing particulate contamination from the liquid.

The single circulation device may be configured to supply to the flow generator, as the liquid, water having a conductivity of less than about $1\times10^{-5}$ Siemens per centimeter. In this regard, water having such a low conductivity tends to act as a good insulator, and is therefore advantageous for use in the strong electric fields generated within the envelope.

The apparatus may further include a conductive reflector outside the envelope and extending from a vicinity of the first electrode to a vicinity of the second electrode. If so, the conductive reflector may be grounded.

The apparatus may further include an exhaust chamber extending outwardly beyond one of the electrodes, configured to accommodate a portion of the flow of liquid. Advantageously, as discussed above, the exhaust chamber tends to improve the stability and reproducibility of the radiant output of the apparatus for both continuous and flash applications, by reducing the effect of turbulence on the arc.

For example, the exhaust chamber may extend axially outwardly sufficiently far beyond the one of the electrodes to isolate it from turbulence resulting from collapse of the flow of liquid within the exhaust chamber.

The flow generator may be configured to generate a flow of gas radially inward from the flow of liquid. In such an embodiment, the exhaust chamber may extend sufficiently far beyond the one of the electrodes to isolate it from turbulence resulting from mixture of the flows of liquid and gas.

The electrodes may be configured to generate an electrical discharge pulse therebetween to produce an irradiance flash. In such an embodiment, the exhaust chamber preferably has a sufficient volume to accommodate a volume of the liquid forced outward by a pressure pulse resulting from the electrical discharge pulse. Advantageously, as discussed above, such an exhaust chamber assists in reducing the peak internal pressure that results from the flash, thereby reducing mechanical stress on the envelope and other components, and also allows water forced axially outwardly by the increased pressure of the flash to continue flowing past the electrode, thereby reducing the tendency of such water to back-splash onto the electrode, which in turn tends to increase electrode life-span and reduce the likelihood of the arc being quenched or extinguished.

The apparatus may further include a plurality of power supply circuits in electrical communication with the electrodes. For example, the plurality of power supply circuits may include a pulse supply circuit configured to generate an electrical discharge pulse between the first and second electrodes, to produce an irradiance flash. The plurality of power supply circuits may further include an idle current circuit configured to generate an idle current between the first and second electrodes. The plurality of power supply circuits may also include a starting circuit configured to generate a starting current between the first and second electrodes. The plurality of power supply circuits may additionally include a sustaining circuit configured to generate a sustaining current between the first and second electrodes.

In such embodiments, the apparatus preferably includes an isolator configured to isolate at least one of the plurality of power supply circuits from at least one other of the plurality of power supply circuits. The isolator may include a mechanical switch. Alternatively, or in addition, the isolator may include a diode.

Each of the electrodes may include a coolant channel for receiving a flow of coolant therethrough.

In addition, at least one of the electrodes may include a tungsten tip having a thickness of at least one centimeter.

Advantageously, for the reasons discussed earlier herein, such electrodes tend to have longer life-spans than conventional electrodes.

The electrodes may be configured to generate an electrical discharge pulse to produce an irradiance flash. In such an embodiment, the apparatus may further include an idle current circuit configured to generate an idle current between the first and second electrodes. The idle current circuit may be configured to generate the idle current for a time period preceding the electrical discharge pulse, the time period being longer than a fluid transit time required by the flow of liquid to travel through the envelope. For example, in an embodiment in which the flow of liquid traverses the envelope in $3\times10^{1}$ milliseconds, the idle current circuit is configured to generate the idle current for at least $3\times10^{1}$ milliseconds.

The idle current circuit may be configured to generate, as the idle current, a current of at least about $1\times10^{2}$ amps. In this regard, as noted above, the coolant channels in the electrodes allow a much higher idle or simmer current than conventional flashlamps, without the severe melting or sputtering that would tend to result if conventional electrodes were subjected to such a high idle current. For the reasons discussed earlier herein, such a high idle current advantageously results in greater consistency and reproducibility of flashes produced by the apparatus, and also tends to reduce loss of electrode material, thereby resulting in longer electrode life.

The idle current circuit may be configured to generate, as the idle current, a current of at least about $4\times10^{2}$ amps, for at least about $1\times10^{2}$ milliseconds. Alternatively, other suitable idle currents and durations may be substituted for particular applications.

In accordance with another aspect of the invention, there is provided an apparatus for producing electromagnetic radiation. The apparatus includes electrically insulated means for generating a flow of liquid along an inside surface of an envelope. The apparatus further includes means for generating an electrical arc within the envelope to produce the electromagnetic radiation.

In accordance with another aspect of the invention, there is provided a method of producing electromagnetic radiation. The method includes generating a flow of liquid along an inside surface of an envelope, using an electrically insulated flow generator. The method further includes generating an electrical arc between first and second electrodes to produce the electromagnetic radiation.

In accordance with another aspect of the invention, there is provided a method including controlling a plurality of apparatuses as described herein to irradiate a common target. The common target may include a semiconductor wafer, for example.

Controlling may include causing each one of the plurality of apparatuses to generate the electrical arc in a direction opposite to that of an electrical arc direction in each adjacent one of the plurality of apparatuses. Advantageously, as discussed above, such a configuration allows the strong magnetic fields generated by adjacent arcs to substantially cancel each other out.

The method may include accommodating a portion of the flow of liquid in an exhaust chamber extending outwardly beyond one of the electrodes. This may include isolating the one of the electrodes from turbulence resulting from collapse of the flow of liquid within the exhaust chamber.

The method may include generating a flow of gas radially inward from the flow of liquid, and accommodating may include isolating the one of the electrodes from turbulence resulting from collapse of the flows of liquid and gas.

Generating an electrical arc may include generating an electrical discharge pulse to produce an irradiance flash, and accommodating may include accommodating a volume of the liquid forced outward by a pressure pulse resulting from the electrical discharge pulse. Advantageously, as discussed above, this tends to increase envelope and electrode life-span, by reducing mechanical stress on the envelope and reducing the likelihood of liquid back-splash onto the electrodes.

The method may further include isolating at least one of a plurality of power supply circuits from others of the plurality of power supply circuits.

The method may further include cooling the first and second electrodes. Cooling may include circulating liquid coolant through respective coolant channels of the first and second electrodes.

Generating the electrical arc may include generating an electrical discharge pulse to produce an irradiance flash, and the method may further include generating an idle current between the first and second electrodes. This may include generating the idle current for a time period preceding the electrical discharge pulse, the time period being longer than a fluid transit time required by the flow of liquid to travel through the envelope. For example, this may include generating the idle current for at least $3\times10^1$ milliseconds. Generating may include generating, as the idle current, a current of at least about $1\times10^2$ amps. For example, this may include generating, as the idle current, a current of at least about $4\times10^2$ amps, for at least about $1\times10^2$ milliseconds. As discussed above, such large idle currents tend to enhance consistency and reproducibility of the flash, in comparison with conventional flashlamps.

In accordance with another aspect of the invention, there is provided an apparatus for producing an irradiance flash. The apparatus includes a flow generator configured to generate a flow of liquid along an inside surface of an envelope. The apparatus further includes first and second electrodes configured to generate an electrical discharge pulse within the envelope to produce the irradiance flash, the pulse causing the electrodes to release particulate contamination different than that released by the electrodes during continuous operation thereof. The apparatus also includes a removal device configured to remove the particulate contamination from the liquid.

Advantageously, therefore, in contrast with previous continuous DC water-wall arc lamps, which are not configured to remove such particulate contamination, such an apparatus is able to prevent such particulate contamination from accumulating within the flow of liquid, thereby preserving the consistency of the output power and spectrum of the apparatus.

The removal device may include a filter configured to filter the particulate contamination from the liquid. For example, the filter may be configured to filter particles as small as two microns. More particularly, the filter may be configured to filter particles as small as one micron. More particularly still, the filter may be configured to filter particles as small as one-half micron.

Alternatively, or in addition, the removal device may include a disposal valve of a fluid circulation system, the disposal valve being operable to dispose of the flow of liquid for at least a fluid transit time required by the flow of liquid to travel through the envelope. For example, if the flow of liquid typically requires thirty milliseconds to traverse the apparatus, the disposal valve can be opened simultaneously or contemporaneously with the flash, and may be left open for at least the fluid transit time (in this example thirty milliseconds), in order to dispose of the potentially contaminated liquid that was present in the envelope at the time of the flash.

In accordance with another aspect of the invention, there is provided an apparatus for producing an irradiance flash. The apparatus includes means for generating a flow of liquid along an inside surface of an envelope. The apparatus further includes means for generating an electrical discharge pulse within the envelope to produce the irradiance flash, the pulse causing the means for generating to release particulate contamination different than that released by the means for generating during continuous operation thereof. The apparatus also includes means for removing the particulate contamination from the liquid.

In accordance with another aspect of the invention, there is provided a method of producing an irradiance flash. The method includes generating a flow of liquid along an inside surface of an envelope. The method further includes generating an electrical discharge pulse within the envelope between first and second electrodes to produce the irradiance flash, the pulse causing the electrodes to release particulate contamination different than that released by the electrodes during continuous operation thereof. The method also includes removing the particulate contamination from the liquid.

Removing may include filtering the particulate contamination from the liquid. Filtering may include filtering particles as small as two microns. For example, filtering may include filtering particles as small as one micron. More particularly, filtering may include filtering particles as small as one-half micron.

Alternatively, or in addition, removing may include disposing of the flow of liquid for at least a fluid transit time required by the flow of liquid to travel through the envelope.

Although numerous features are shown and described in combination herein, in the context of a preferred embodiment of the invention, it will be appreciated that many such features may be employed independently of each other, if desired.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
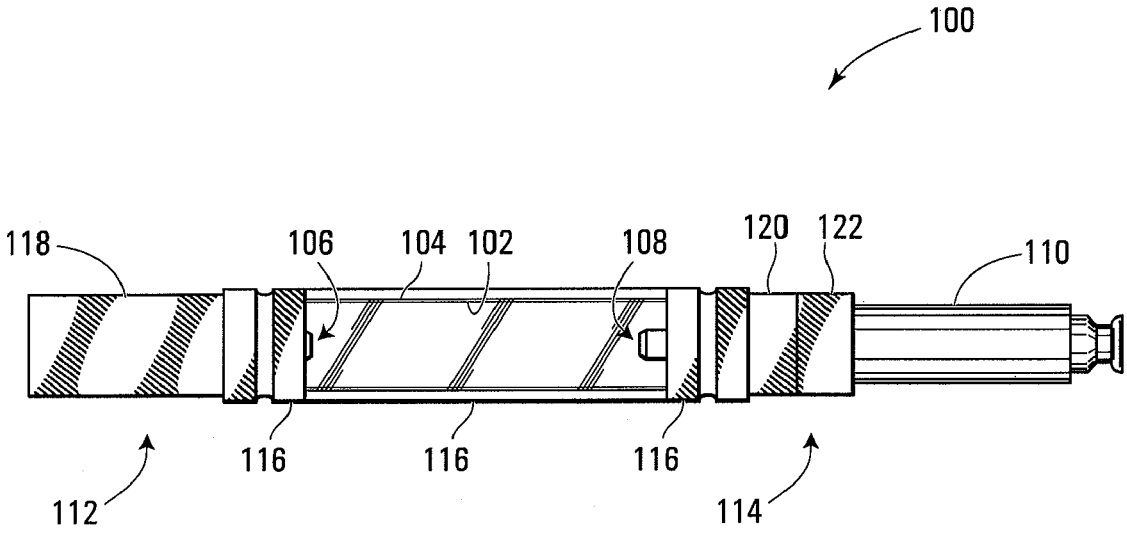
FIG. 1 is a front elevation view of an apparatus for producing electromagnetic radiation, according to a first embodiment of the invention.

Referring to FIG. 1, an apparatus for producing electromagnetic radiation according to a first embodiment of the invention is shown generally at 100. In this embodiment, the apparatus 100 includes a flow generator (not shown in FIG. 1) configured to generate a flow of liquid along an inside surface 102 of an envelope 104. The apparatus 100 includes first and second electrodes, which in this embodiment include a cathode 106 and an anode 108 respectively. The cathode and anode are configured to generate an electrical arc within the envelope 104 to produce the electromagnetic radiation. In this embodiment, the apparatus 100 further includes an exhaust chamber shown generally at 110, extending outwardly beyond one of the electrodes, configured to accommodate a portion of the flow of liquid.

More particularly, in this embodiment the exhaust chamber 110 extends axially outwardly beyond the anode 108. In the present embodiment, the exhaust chamber 110 extends axially outwardly sufficiently far beyond the anode 108 to isolate the anode 108 from turbulence resulting from collapse of the flow of liquid within the exhaust chamber 110.

In this embodiment, the electrodes, or more particularly the cathode 106 and the anode 108, are configured to generate an electrical discharge pulse, to produce an irradiance flash. Also in this embodiment, the exhaust chamber 110 has a sufficient volume to accommodate a volume of the liquid forced outward by a pressure pulse resulting from the electrical discharge pulse. Advantageously, therefore, as discussed above, the exhaust chamber 110 tends to increase the life-span of the envelope 104 and the electrodes, by reducing mechanical stress on the envelope and reducing the likelihood of liquid back-splash onto the electrodes.

In this embodiment, the apparatus 100 includes a cathode side shown generally at 112, and an anode side shown generally at 114. A reflector, which in this embodiment includes a conductive reflector 116, connects the cathode and anode sides together. In this embodiment the conductive reflector 116 is electrically grounded.

In the present embodiment, the cathode side 112 includes an insulative housing 118, which in the present embodiment is bolted to the conductive reflector 116. The anode side 114 includes first and second anode housing members 120 and 122, connected between the reflector 116 and the exhaust chamber 110.

Figure 2:
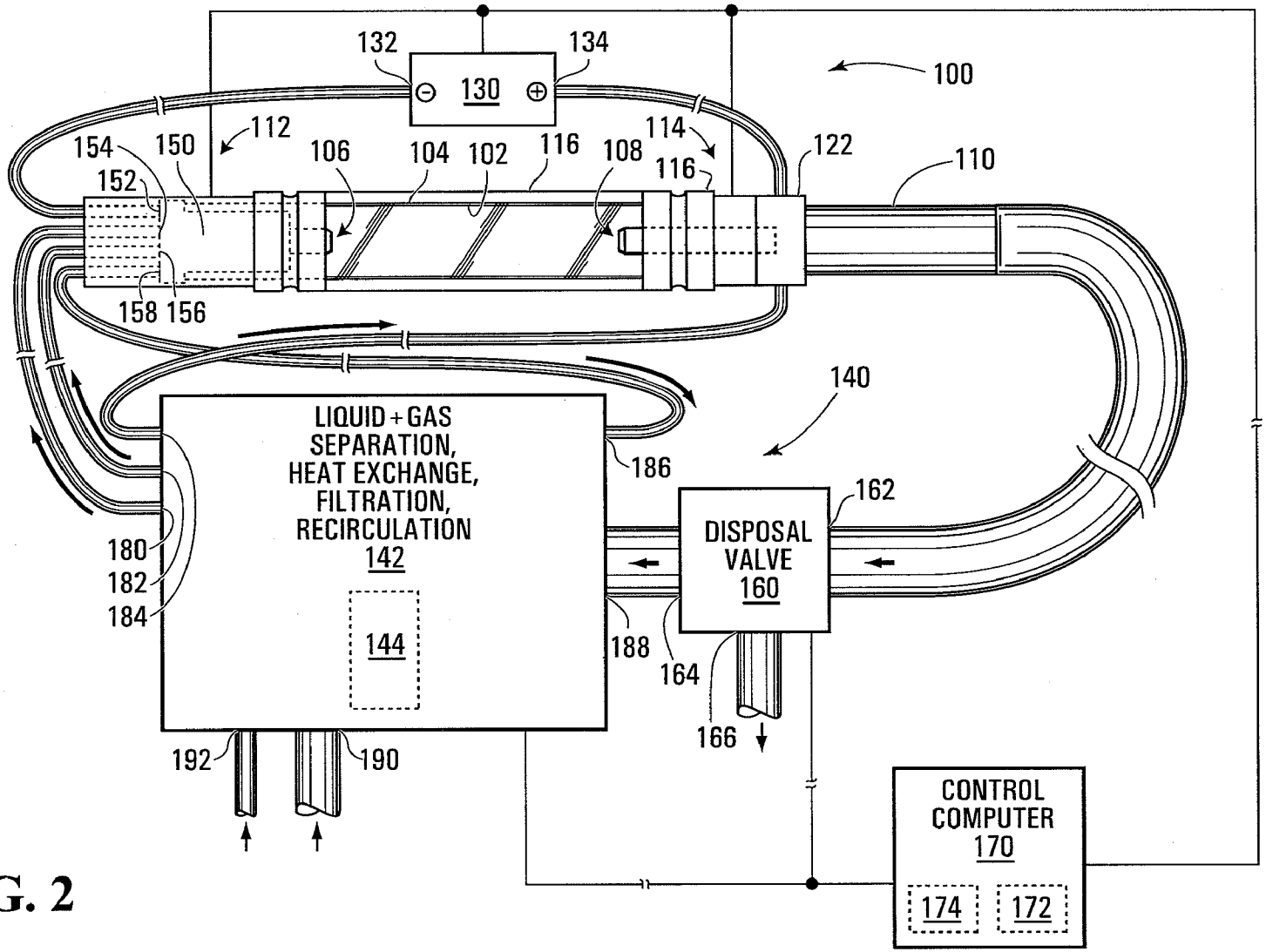
FIG. 2 is shows the apparatus of FIG. 1 with block diagram representations of an electrical power supply system, a fluid circulation system, and a control computer.

Referring to FIG. 2, the apparatus 100 is shown in electrical communication with an electrical power supply system shown generally at 130, and in fluidic communication with a fluid circulation system shown generally at 140.

In this embodiment, the apparatus 100 includes the flow generator, which is shown at 150 in FIG. 2. In this embodiment, the flow generator is electrically insulated.

In the present embodiment, the flow generator 150 is contained within the cathode side 112 of the apparatus 100. The flow generator 150 of the present embodiment includes an electrical connector 152 for connecting the flow generator 150 to the electrical power supply system 130. The flow generator 150 further includes a liquid inlet port 154 and a gas inlet port 156, for receiving liquid and gas respectively, from the fluid circulation system 140. The flow generator 150 further includes a liquid outlet port 158 for returning cathode coolant liquid to the fluid circulation system.

In this embodiment, the fluid circulation system 140 includes a separation and purification system 142, similar to those described in the aforementioned U.S. patents. Generally, the separation and purification system 142 receives liquid and gas from the exhaust chamber 110 of the apparatus 100, separates the liquid from the gas, cools both the liquid and the gas, filters and purifies the liquid and gas, and recirculates the liquid and gas back to the flow generator 150 to be re-circulated back through the apparatus 100 in the form of vortexing flows of liquid and gas, as described herein and in the aforementioned U.S. patents. In addition, in the present embodiment the separation and purification system receives liquid coolant from the cathode 106 via the liquid outlet port 158, and from the anode 108 via the exhaust chamber 110. The received liquid coolant is similarly cooled and purified, and then returned to the flow generator 150 and to the second anode housing member 122 to be recirculated through internal cooling channels (not shown in FIG. 2) of the cathode and anode.

In this embodiment, the electrical discharge pulse generated between the first and second electrodes within the envelope 104 to produce the irradiance flash causes the electrodes to release particulate contamination different than that released by the electrodes during continuous operation thereof. More particularly, the present inventors have found that such an electrical discharge pulse causes the cathode 106 and the anode 108 to release particulate contamination including particles as small as 0.5-2.0 μM, in contrast with continuous DC operation, in which the particulate contamination released by the cathode and anode typically does not include particles smaller than 5 μm.

Thus, in the present embodiment, the apparatus 100 includes at least one removal device configured to remove such different particulate contamination from the liquid received from the exhaust chamber 110. More particularly, in this embodiment the fluid circulation system 140 of the apparatus 100 includes two such removal devices, namely, a filter 144 within the separation and purification system 142, and a disposal valve 160.

The disposal valve 160 includes an inlet port 162, via which it receives liquid and gas from the exhaust chamber 110 of the apparatus 100. The disposal valve further includes a recirculation outlet port 164, via which it forwards the received liquid and gas to the separation and purification system 142. The disposal valve 160 also includes a disposal outlet port 166, via which it disposes of the received liquid and gas when desired. By default, the recirculation outlet port 164 is open, and the disposal outlet port 166 is closed. However, in this embodiment, the disposal valve is operable to dispose of the flow of liquid received from the exhaust chamber 110 for at least a fluid transit time required by the flow of liquid to travel through the envelope 104. More particularly, in this embodiment the transit time of the vortexing flow of liquid across the envelope 104 is on the order of 30 milliseconds. Thus, following each electrical discharge pulse, the disposal valve 160 is controllable to close the recirculation outlet port 164 and open the disposal outlet port 166, for at least 30 milliseconds. More particularly, in this embodiment the disposal valve is controllable to maintain the recirculation outlet port 164 closed and the disposal outlet port 166 open for at least 100 ms following each electrical discharge pulse, in order to allow sufficient time for all of the liquid that was present in the envelope 104 at the time of the electrical discharge pulse to be disposed of.

In this embodiment, the actuation of the disposal valve 160 is controlled by a main controller 170, which is also in communication with the electrical power supply system 130, the separation and purification system 142, and with various sensors (not shown) of the apparatus 100. In this embodiment the main controller 170 includes a control computer including a processor circuit 172, which in this embodiment includes a microprocessor. The processor circuit 172 is configured by executable codes stored on a computer-readable medium 174, which in this embodiment includes a hard disk drive, to control the various elements of the present embodiment to carry out the functionality described herein. Alternatively, other suitable system controllers, other computer-readable media, or other ways of generating signals embodied in communications media or carrier waves to direct the controller to carry out the functionality described herein, may be substituted.

In this embodiment, the filter 144 is configured to filter the particulate contamination from the liquid. Thus, in the present embodiment, the filter is configured to filter particles as small as two microns from the liquid. More particularly, in this embodiment the filter is configured to filter particles at least as small as one micron from the liquid. More particularly still, in this embodiment the filter is configured to remove particles at least as small as one-half micron from the liquid.

In the present embodiment the separation and purification system 142 of the fluid circulation system 140 includes a main liquid outlet port 180 for conveying liquid to the liquid inlet port 154 of the flow generator 150, to provide the liquid required for the vortexing flow of liquid along the inside surface 102 of the envelope 104, as well as coolant for the cathode 106. The separation and purification system 142 further includes a gas outlet port 182 for conveying gas to the gas inlet port 156 of the flow generator 150, and a second liquid outlet port 184 for conveying anode coolant liquid to the anode 108 via the second anode housing member 122. The system 142 further includes a coolant inlet port 186 for receiving liquid coolant from the cathode 106 via the liquid outlet port 158 of the flow generator 150, and a main inlet port 188 for receiving liquid and gas from the exhaust chamber 110 via the disposal valve 160. The system 142 also includes a liquid replenishment input port 190 and a gas replenishment input port 192, for receiving replenishing supplies of liquid and gas to replace the amounts disposed of by the disposal valve 160 following each flash.

In this embodiment, the liquid replenishment input port 190 is in communication with a supply of purified water, which acts as both the liquid for the vortexing flow of liquid and the electrode coolant. More particularly, in this embodiment the purified water has a conductivity of less than about ten micro-Siemens per centimeter. More particularly still, in this embodiment the conductivity of the purified water is in the range between about five and about ten micro-Siemens per centimeter. Water of such low conductivity acts as a good electrical insulator, and is therefore advantageous for use in the present embodiment, in which the water will be exposed to strong electric fields within the envelope 104. Alternatively, if desired, other suitable liquids may be substituted for a particular application.

In this embodiment, the gas replenishment input port 192 is in communication with a supply of inert gas, which in this embodiment is argon. In the present embodiment, argon is preferred due to its relatively low cost compared to other inert gases such as xenon or krypton. Alternatively, however, other suitable gases or gas mixtures may be substituted if desired.

In this embodiment, the electrical supply system 130 includes a negative terminal in communication with the cathode 106, and a positive terminal 134 in communication with the anode 108. More particularly, in this embodiment the negative terminal 132 is connected to the electrical connector 152 of the flow generator 150, which in this embodiment includes a conductor and is in electrical communication with the cathode 106. Similarly, in this embodiment the positive terminal 134 is connected to the second anode housing member 122, which also includes a conductor, and which is in electrical communication with the anode 108. In this embodiment, the positive terminal 134 is electrically grounded, and any required voltages are generated by lowering the electrical potential of the negative terminal 132 relative to that of the grounded positive terminal 134. Therefore, in the present embodiment, externally-exposed conductive components of the apparatus 100, such as the second anode housing member 122 and the reflector 116, are maintained at the same (grounded) electrical potential.

Cathode Side

Figure 3:
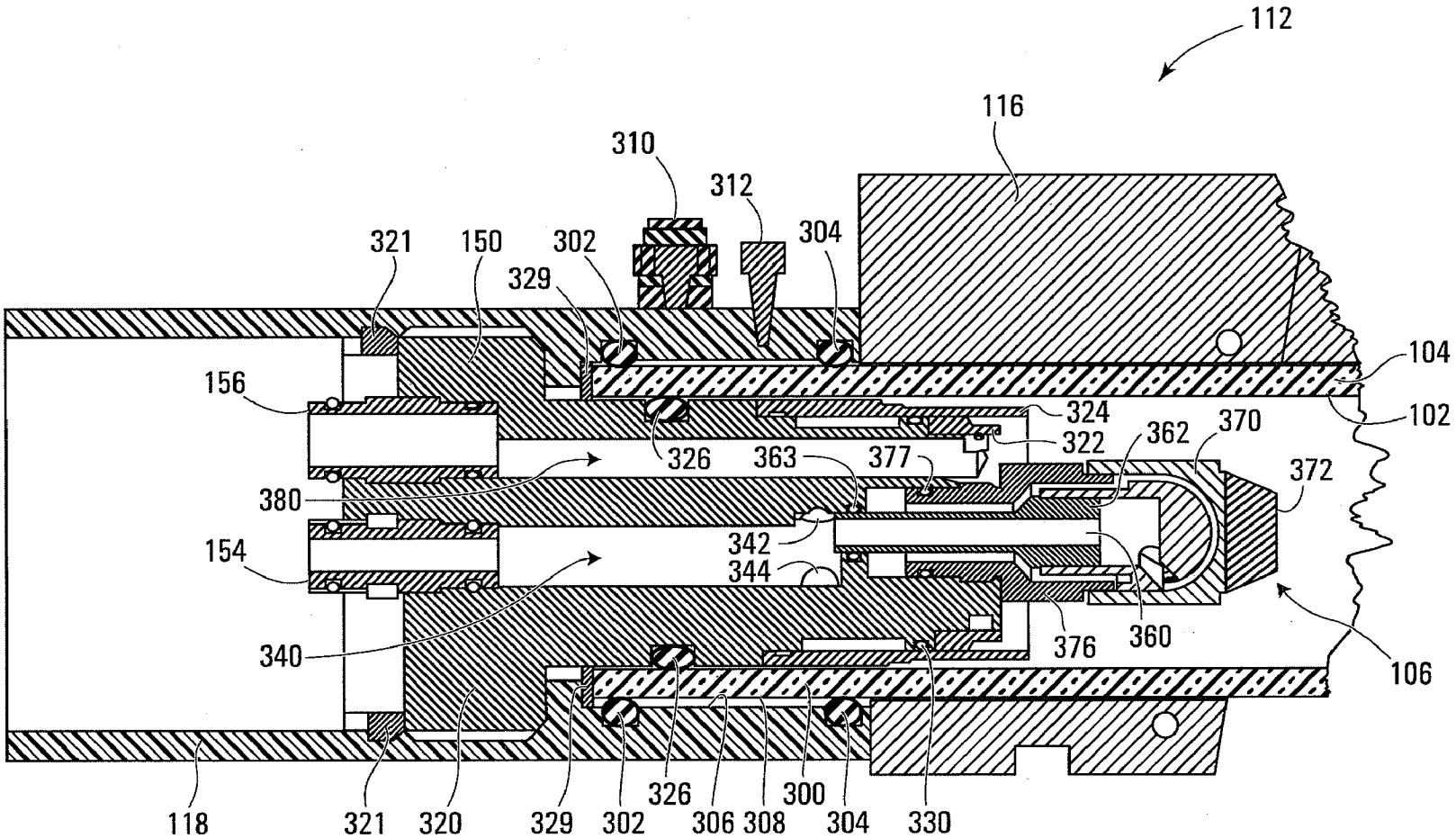
FIG. 3 is a fragmented cross-section of a cathode portion of the apparatus shown in FIG. 1.

Referring to FIGS. 1-3, the cathode side 112 of the apparatus 100 is shown in greater detail in FIG. 3. In this embodiment, the cathode side 112 includes the flow generator 150, which in this embodiment is electrically insulated, and is configured to generate the flow of liquid along the inside surface 102 of the envelope 104.

In this embodiment, the electrically insulated flow generator 150 includes a conductor. More particularly, in this embodiment the flow generator 150 is composed of brass. In this regard, brass has a suitable mechanical strength to withstand the mechanical stresses resulting from the flash, and acts as a conductive electrical pathway between the cathode 106 and the electrical power supply system 130, the negative terminal 132 of which is connected to the flow generator 150 at the electrical connector 152 thereof (the electrical connector 152 and the liquid outlet port 158 shown in FIG. 2 are not shown in FIG. 3, as they are not within the plane of the cross-section shown in FIG. 3). Thus, in the present embodiment, in addition to generating the vortexing flows of liquid and gas as described in greater detail below, the flow generator 150 and its electrical connector 152 act as an electrical connection to the cathode 106. Alternatively, rather than brass, the flow generator 150 may include one or more other suitable conductors.

Or, as a further alternative, rather than being surrounded by insulative material as in the present embodiment, the flow generator 150 may be electrically insulated by virtue of being composed of or including an electrically insulative material, in which case the electrical connection to the cathode may be provided through additional wiring, if desired.

In this embodiment, in which the flow generator 150 is a conductor, the cathode side 112 includes electrical insulation surrounding the flow generator 150. More particularly, in this embodiment the electrical insulation surrounding the flow generator 150 includes the envelope 104, and further includes the insulative housing 118. As shown in FIG. 3, in this embodiment the insulative housing 118 surrounds at least a portion of the envelope 104, or more particularly, an end portion 300 of the envelope 104.

In the present embodiment, the insulative housing 118 includes at least one of a plastic and a ceramic. More particularly, in this embodiment the insulative housing 118 is composed of ULTEM™ plastic. Alternatively, other suitable insulative materials, such as other plastics or a ceramic for example, may be substituted.

In this embodiment, the envelope 104 includes a transparent cylindrical tube. In the present embodiment, the tube has a thickness of at least four millimeters. More particularly, in this embodiment the tube has a thickness of at least five millimeters. More particularly still, in this embodiment the tube has a thickness of five millimeters, and has an inside diameter of 45 millimeters and an outside diameter of 55 millimeters. As discussed earlier herein, it will be appreciated that tubes thicker than 3 mm have generally been considered unsuitable for flashlamp applications due to the thermal gradients that result between the plasma-heated inner surface and the cooled outer surface of the tube in conventional flashlamps. The vortexing flow of liquid along the inside surface 102 of the envelope 104 reduces such thermal gradients, thereby allowing a thicker tube to be used as the envelope 104. Accordingly, the envelope 104 in the present embodiment has greater mechanical strength than conventional flashlamp tubes due to its greater thickness, and is thus better able to withstand the mechanical stresses associated with the rapid changes in pressure caused by the flash.

In this embodiment, the envelope 104 includes a precision bore cylindrical tube. More particularly, in this embodiment the precision bore cylindrical tube has a dimensional tolerance at least as low as 0.05 millimeters. In this regard, such precision bores tend to provide more reliable seals to withstand the high pressure inside the envelope during the flash. In addition, the enhanced smoothness of the inside surface of the envelope tends to improve the performance of the vortexing flow of liquid flowing along the inside surface of the envelope, and also tends to reduce electrode erosion.

In the present embodiment, the envelope 104, or more particularly, the precision bore cylindrical tube, includes a quartz tube. More particularly still, in this embodiment the quartz tube is a cerium-doped quartz tube, doped with cerium oxide to avoid the solarization/discoloration difficulties described earlier herein. Thus, in the present embodiment, by avoiding such solarization/discoloration, the consistency and reproducibility of the output spectrum of flashes produced by the apparatus 100 are improved. Alternatively, the envelope 104 may include pure quartz, such as synthetic quartz for example, which also tends to avoid solarization/discoloration disadvantages. Alternatively, however, the envelope 104 may include materials that do suffer from solarization, such as ordinary clear fused quartz for example, if spectral consistency and reproducibility are not important for a particular application. More generally, other transparent materials, such as sapphire for example, may be substituted if desired, depending on the mechanical and thermal robustness required for a particular application.

In the present embodiment, the electrical insulation, or more particularly, the envelope 104 and the insulative housing 118, surround the cathode 106 and an electrical connection thereto. As noted above, in this embodiment the electrical connection to the cathode 106 includes the flow generator 150 and the electrical connector 152 (not shown in the plane of the cross-section of FIG. 3), through which the cathode 106 is in electrical communication with the negative terminal 132 of the electrical power supply system 130 shown in FIG. 2.

In this embodiment, the electrical insulation surrounding the flow generator 150 further includes gas in a space between the insulative housing 118 and the end portion 300 of the envelope 104. More particularly, in this embodiment the apparatus 100 includes a pair of spaced apart seals 302 and 304, cooperating with an inner surface 306 of the insulative housing 118 and an outer surface 308 of the end portion 300 of the envelope 104 to seal the gas in the space. In this embodiment, the gas is compressed. More particularly, in this embodiment the gas is compressed nitrogen. In order to pressurize the space between the surfaces 306 and 308 and the seals 302 and 304 with compressed $N_2$, the insulative housing 118 includes an inlet valve 310 and an outlet valve 312. In this embodiment, the nitrogen pressure between the seals 302 and 304 is maintained at a higher pressure than a typical pressure within the envelope 104. More particularly, in the present embodiment the pressure within the envelope is typically on the order of about 2 atmospheres, and the nitrogen gas pressure between the seals is maintained at about triple this pressure, or in other words, on the order of about 6 atmospheres. It has been found that such pressurized insulation in the space between the seals 302 and 304, which keeps the space clean and dry, assists in providing an ideal set of starting conditions for the arc.

In this embodiment, the seals 302 and 304 include O-rings, although alternatively, other suitable seals may be substituted.

Referring to FIGS. 2, 3, 4 and 5, in addition to generating the flow of liquid on the inside surface 102 of the envelope 104, in this embodiment the flow generator 150 is also configured to generate a flow of gas radially inward from the flow of liquid. Therefore, in the present embodiment, the exhaust chamber 110 extends sufficiently far beyond the anode 108 to isolate the anode 108 from turbulence resulting from mixture of the flows of liquid and gas within the exhaust chamber 110.

Figure 4:
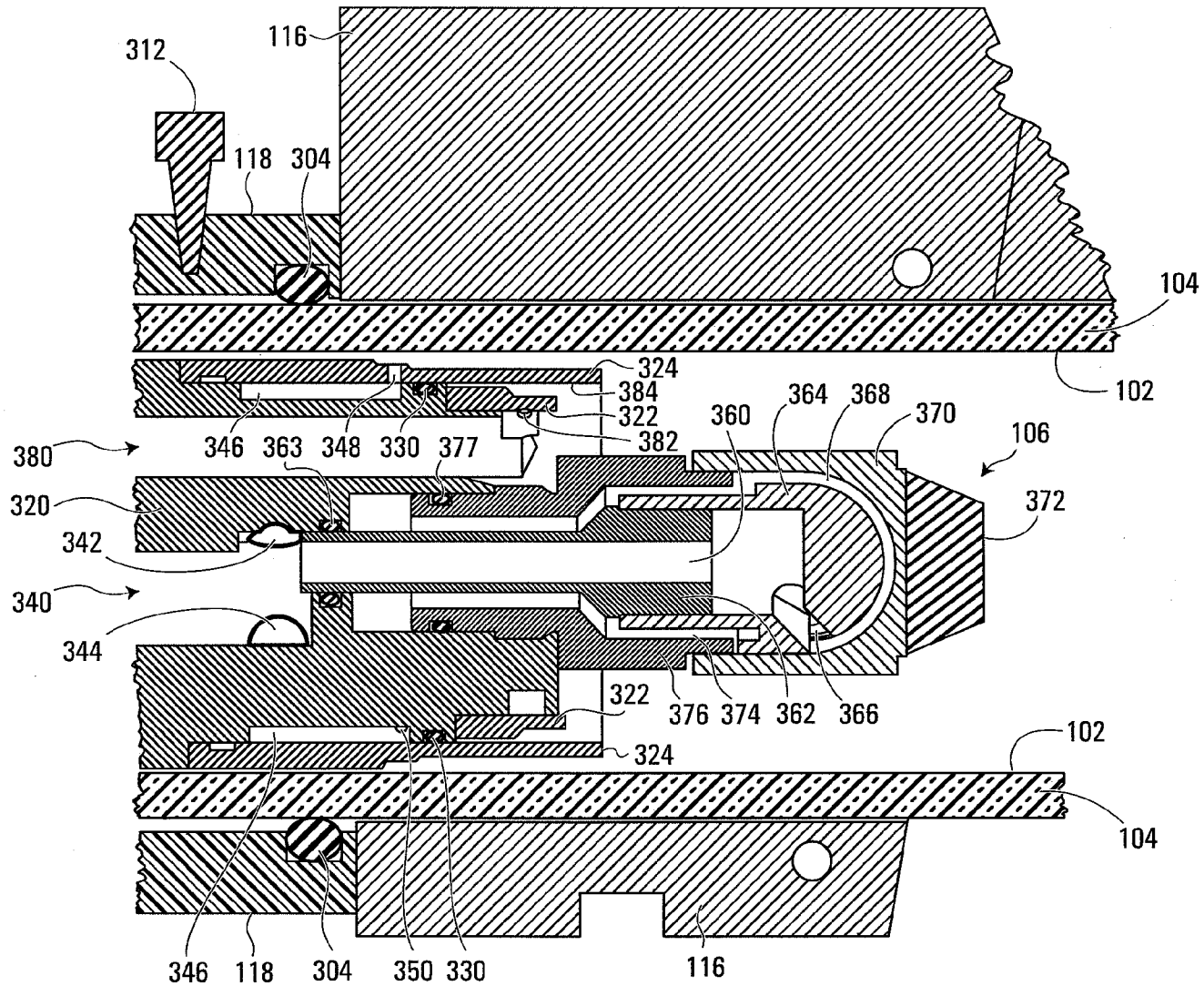
FIG. 4 is a detail of the cross-section of the cathode portion shown in FIG. 3.
Figure 5:
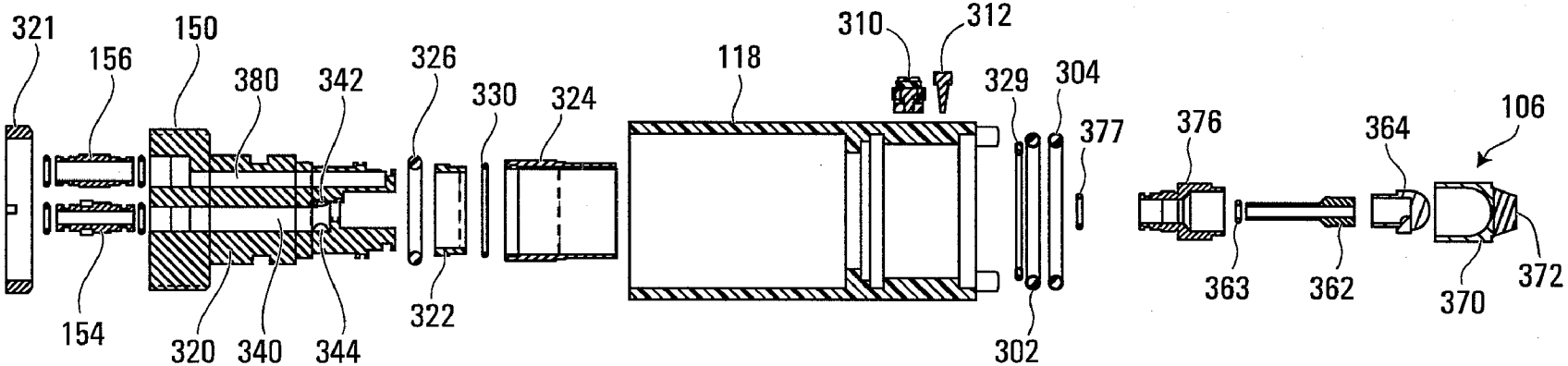
FIG. 5 is an exploded cross-section of the cathode portion shown in FIG. 3.
Figure 6:
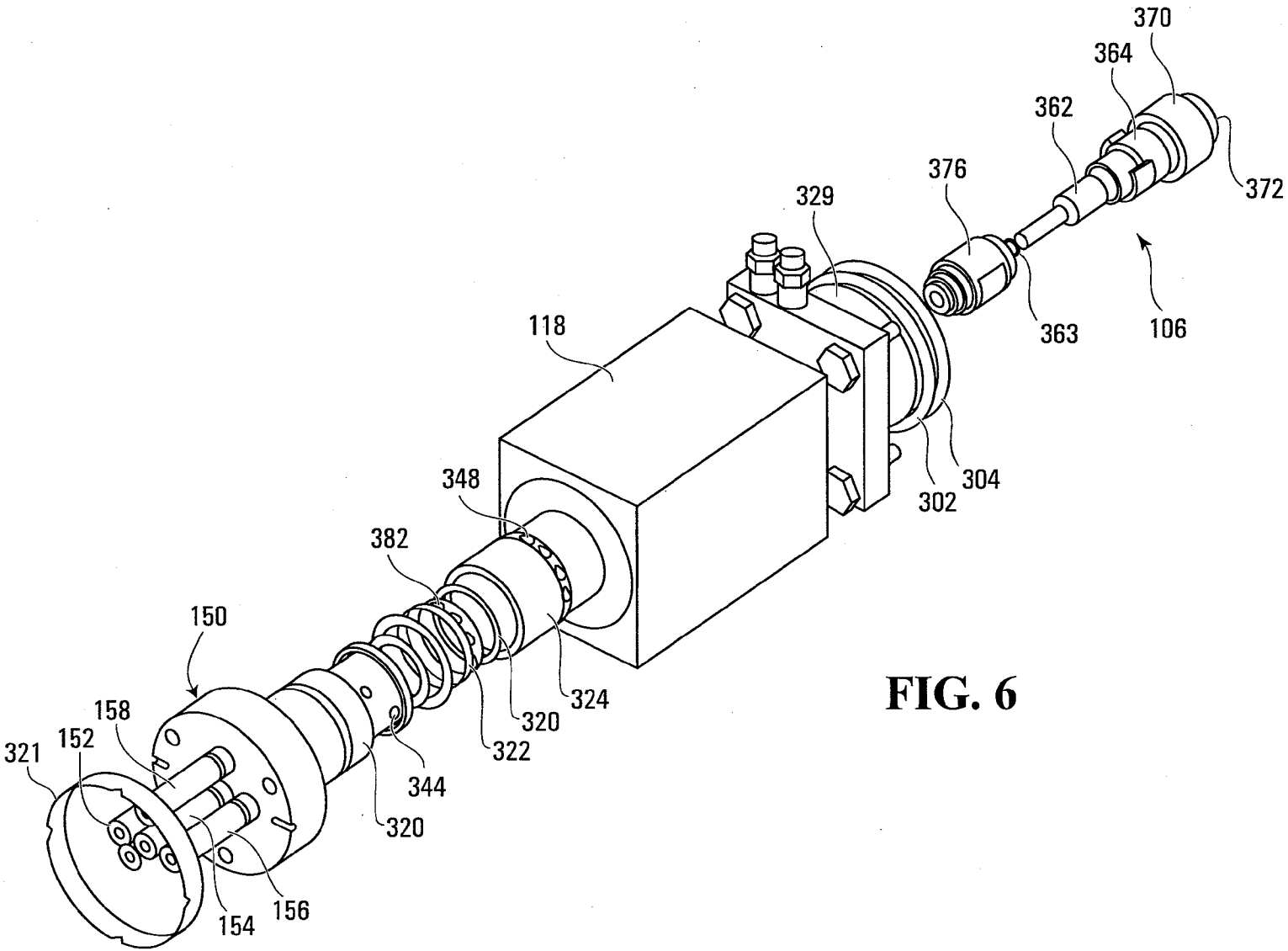
FIG. 6 is an exploded perspective view of the cathode portion shown in FIG. 3.

Referring to FIGS. 3, 4 and 5, to generate the flows of liquid and gas, in the present embodiment the flow generator 150 includes a flow generator core 320, threadedly connected to a gas vortex generator 322 and a liquid vortex generator 324. In this embodiment, the gas and liquid vortex generators are threaded in a direction opposite to that of the vortexing liquid and gas flows, so that the reactionary pressures from the liquid and gas flows are in a rotational direction that tends to tighten, rather than loosen, the threaded connections. Alternatively, other suitable ways of connecting the gas and liquid vortex generators to the core may be substituted.

In the present embodiment, a locking ring 321 prevents loosening of the flow generator core 320 within the insulative housing 118. A seal 326, which in this embodiment includes an O-ring, provides a tight seal between the flow generator core 320 and the inside surface 102 of the envelope 104.

In addition, in this embodiment a washer 329 is interposed between an outer edge of the envelope 104 and the insulative housing 118. In the present embodiment, the washer 329 includes Teflon, although alternatively, other suitable materials may be substituted.

A further seal 330 provides a tight seal between the flow generator core 320 and the liquid vortex generator 324.

Referring to FIGS. 2 to 5, in this embodiment, to generate a vortexing flow of liquid on the inside surface 102 of the envelope 104, pressurized liquid from the fluid circulation system 140 is received at the flow generator 150, via the liquid inlet port 154 thereof. The pressurized liquid travels through a liquid intake channel 340 defined within the flow generator core 320. Some of the liquid is forced through a plurality of holes, such as those shown at 342 and 344, which extend through the body of the flow generator core 320 into a manifold space 346 defined between the flow generator core 320 and the liquid vortex generator 324. From the manifold space 346, the liquid is forced through a plurality of holes, such as those shown at 348 and 350, which extend through the body of the liquid vortex generator 324 (the hole 350 is not in the plane of the cross-section of FIGS. 3-5, but a portion of it can be seen through the manifold space 346 in FIG. 4). Each of the holes 348 and 350 and other similar holes through the body of the liquid vortex generator 324 is angled, so that as the liquid is forced through the holes, it acquires a velocity with components in not only the radial and axial directions relative to the envelope, but also a velocity component tangential to the circumference of the inside surface 102 of the envelope. Thus, as the pressurized liquid exits the holes 348, 350 and other similar holes, it forms a vortexing liquid wall, circling around the inside surface 102 of the envelope 104 as it traverses the envelope in the axial direction toward the anode 108.

In this embodiment, each of the electrodes includes a coolant channel for receiving a flow of coolant therethrough. More particularly, in the present embodiment, in addition to the portion of the incoming liquid which exits the liquid intake channel 340 through the holes 342 and 344 to form the vortexing flow of liquid as described above, a remaining portion of the liquid flowing through the liquid intake channel 340 is forced into a cathode coolant channel 360, and acts as a coolant to cool the cathode 106.

In this embodiment, the cathode 106 includes a hollow cathode pipe 362, which in this embodiment is brass. An open outer end of the cathode pipe 362 is threaded into an aperture defined through the flow generator core 320, with a seal 363 providing a tight seal between the cathode pipe and the flow generator core. A cathode insert 364, which is also brass in the present embodiment, is threadedly connected to an inner end of the cathode pipe 362. The cathode 106 further includes a cathode body 376 surrounding the cathode pipe 362. The cathode body 376, which in this embodiment is brass, is threaded into a wider portion of the aperture defined through the flow generator core 320, with a seal 377 providing a tight seal between the cathode body and the flow generator core. In this embodiment, the cathode 106 further includes a cathode head 370 threadedly connected to the cathode body 376 and surrounding the cathode insert 364. A cathode tip 372 is mounted to the cathode head 370. In this embodiment, the cathode head 370 and the cathode tip 372 are both conductors. More particularly, in this embodiment the cathode head 370 includes copper, and the cathode tip 372 includes tungsten. Thus, referring to FIGS. 2-4, it will be appreciated that an electrical pathway is formed from the negative terminal 132 of the electrical power supply system 130, through the electrical connector 152 and the flow generator core 320, through the cathode body 376 and the cathode head 370, to the cathode tip 372, thus allowing electrons to flow from the negative terminal 132 to the cathode tip 372 for establishing an arc between the cathode 106 and the anode 108.

If desired, other suitable types of connections may be substituted for the various threaded connections. For example, the cathode head 370 may be soldered or welded to the cathode body 376, if desired.

In this embodiment, the cathode coolant channel 360 is defined within the hollow cathode pipe 362. The coolant liquid continues through the coolant channel 360, into the hollow cathode insert 364. The coolant liquid travels through a hole 366 defined through the cathode insert 364, and into a space 368 defined between the cathode insert 364 and the cathode head 370, to which the cathode tip 372 is mounted. Thus, as the coolant liquid travels through the space 368, it removes heat from the cathode head 370 and hence indirectly from the cathode tip 372. As discussed in greater detail below in connection with a similar head of the anode 108, in this embodiment an inside surface (not shown) of the cathode head 370 has a plurality of parallel grooves (not shown), for directing the flow of liquid coolant in a desired direction. The coolant liquid is directed by the grooves through the space 368, and then enters a space 374 defined between the cathode pipe 362 and the cathode body 376. From the space 374, the coolant liquid enters a coolant exit channel (not shown in the plane of the cross-section of FIGS. 3-5) defined within the flow generator core 320, which leads to the liquid outlet port 158 shown in FIG. 2, via which the coolant liquid is returned to the coolant inlet port 186 of the separation and purification system 142 of the fluid circulation system 140.

In this embodiment, the tungsten cathode tip 372 has a thickness of at least one centimeter. Advantageously, therefore, as discussed earlier herein, the combination of liquid cooling of the cathode 106 as described above, and the relatively thick tungsten cathode tip 372, tends to provide the cathode 106 with a greater lifespan than conventional electrodes.

In this embodiment, the gas vortex generator 322 generates a vortexing flow of gas, in a manner similar to that in which the liquid vortex generator 324 generates the vortexing flow of liquid described above. In this embodiment, pressurized gas is received from the gas outlet port 182 of the separation and purification system 142, at the gas inlet port 156 of the flow generator 150. The pressurized gas travels through a gas intake channel 380 defined within the flow generator core 320, eventually exiting the gas intake channel via a plurality of holes, such as that shown at 382, which extend through the body of the gas vortex generator 322 (the hole 382 is not in the plane of the cross-section of FIGS. 3-5 but can be seen in FIG. 4). The pressurized gas exits through the hole 382 and similar holes, and strikes an inside surface 384 of the liquid vortex generator 324. Like the holes 348 and 350 of the liquid vortex generator 324, the hole 382 and other similar holes of the gas vortex generator 322 are angled, so that the exiting gas has velocity components not only in the axial and radial directions relative to the envelope, but also has a velocity component in a direction tangential to an inner circumference of the inside surface 384 of the liquid vortex generator 324. Thus, as the gas is forced out through the hole 382 and other similar holes, it forms a vortexing gas flow, circling around in a circumferential direction as it traverses the envelope 104 in the axial direction. In this embodiment, the angles of the holes 382 and similar holes of the gas vortex generator 322 are angled in the same direction as the holes 348 and 350 and similar holes of the liquid vortex generator 324, so that the liquid and gas vortexes rotate in the same direction as they traverse the envelope.

Referring back to FIGS. 3 and 4, in this embodiment the cathode 106 has a protrusion length along which it protrudes axially inwardly within the envelope 104 toward a center of the apparatus 100 beyond a next-most-inner component of the apparatus within the envelope. In this embodiment, the next-most-inner component is the flow generator 150, or more particularly, the liquid vortex generator 324 thereof.

In the present embodiment, the cathode's protrusion length is less than double a diameter of the cathode 106. Thus, the cathode 106 is shorter relative to its diameter than conventional cathodes, which gives it greater rigidity and mechanical strength to withstand the large abrupt pressure changes associated with the flash. In absolute terms, in the present embodiment the protrusion length of the cathode beyond the flow generator is less than five centimeters.

At the same time, however, in the present embodiment the protrusion length of the cathode 106 is sufficiently long to prevent the electrical discharge pulse from occurring between the flow generator 150 and the anode 108, rather than between the cathode and the anode. More particularly, in this embodiment the protrusion length is at least three and a half centimeters.

In the present embodiment, the cathode tip 372 of the cathode 106 has a thickness of at least one centimeter. Advantageously, therefore, as discussed earlier herein, the combination of liquid cooling of the cathode 106 as described below, and the relatively thick tungsten cathode tip 372, tends to provide the cathode 106 with a greater lifespan than conventional electrodes.

Anode Side

Figure 7:
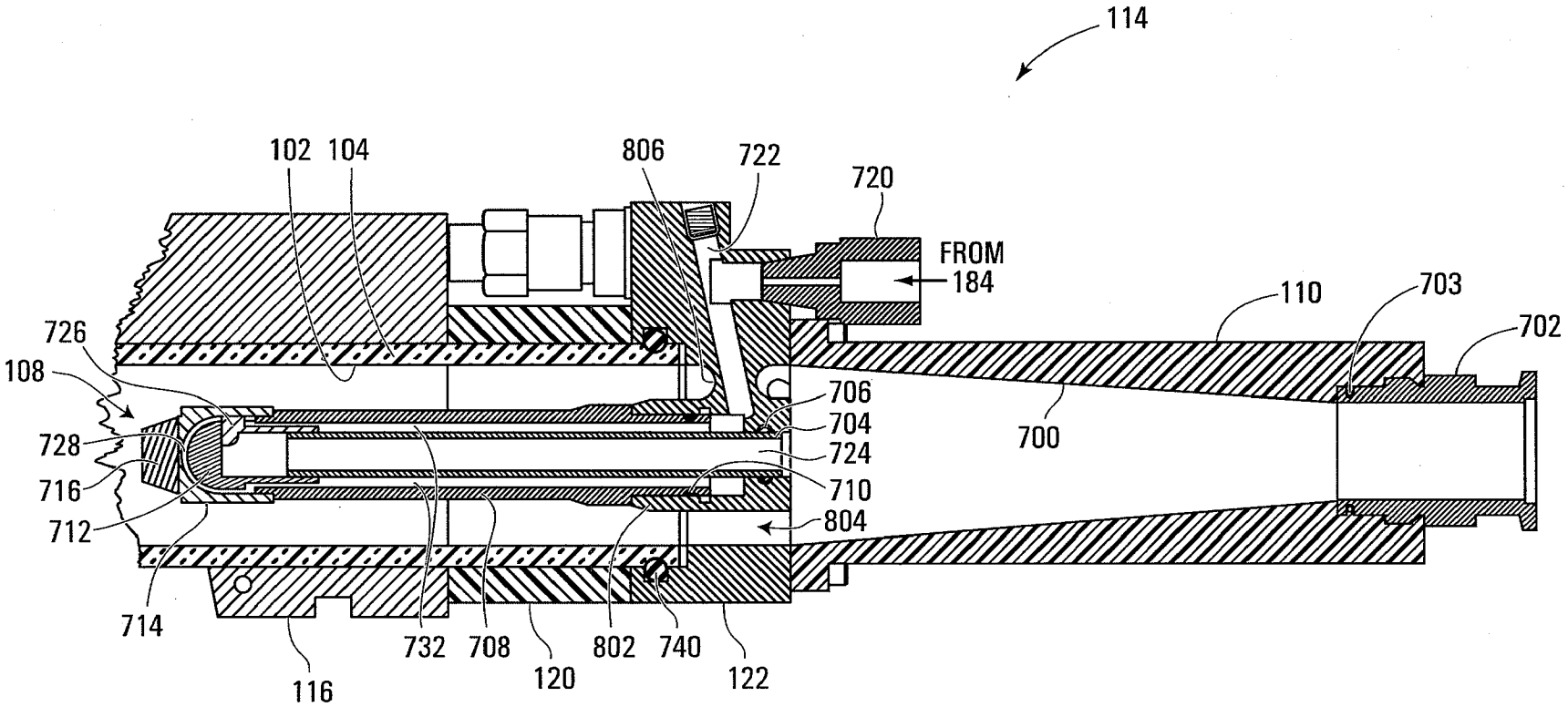
FIG. 7 is a fragmented cross-section of an anode portion of the apparatus shown in FIG. 1.

Referring to FIGS. 2 and 7-10, the anode side 114 of the apparatus 100 is shown in greater detail in FIG. 7. Generally, in this embodiment the anode side 114 includes the anode 108, the reflector 116, the first and second anode housing members 120 and 122, and the exhaust chamber 110.

In this embodiment, the exhaust chamber 110 has an inside surface 700, which in this embodiment has a frustoconical shape, tapering radially inwards while extending axially outwards past the anode 108. Alternatively, however, the inside surface may be cylindrical, or may taper outwards rather than inwards. It is preferable that the inside surface 700 of the exhaust chamber 110 be configured to allow the flow of liquid to continue vortexing along the inside surface 700 after it has left the envelope 104, so that the vortexing liquid continues to be separated from the vortexing flow of gas within the exhaust chamber 110, as this allows gas (rather than a mixture of gas and water) to be drawn back into the envelope 104 when the arc is established.

In this embodiment, the exhaust chamber 110 is connected to a fitting 702, which in the present embodiment is a stainless steel fitting. A seal 703, which in this embodiment includes an O-ring, provides a tight seal between the inside surface 700 of the exhaust chamber 110 and the fitting 702. The fitting 702 is connected to a hose through which the vortexing flows of liquid and gas exiting the exhaust chamber 110 are returned to the fluid circulation system 140.

Figure 8:
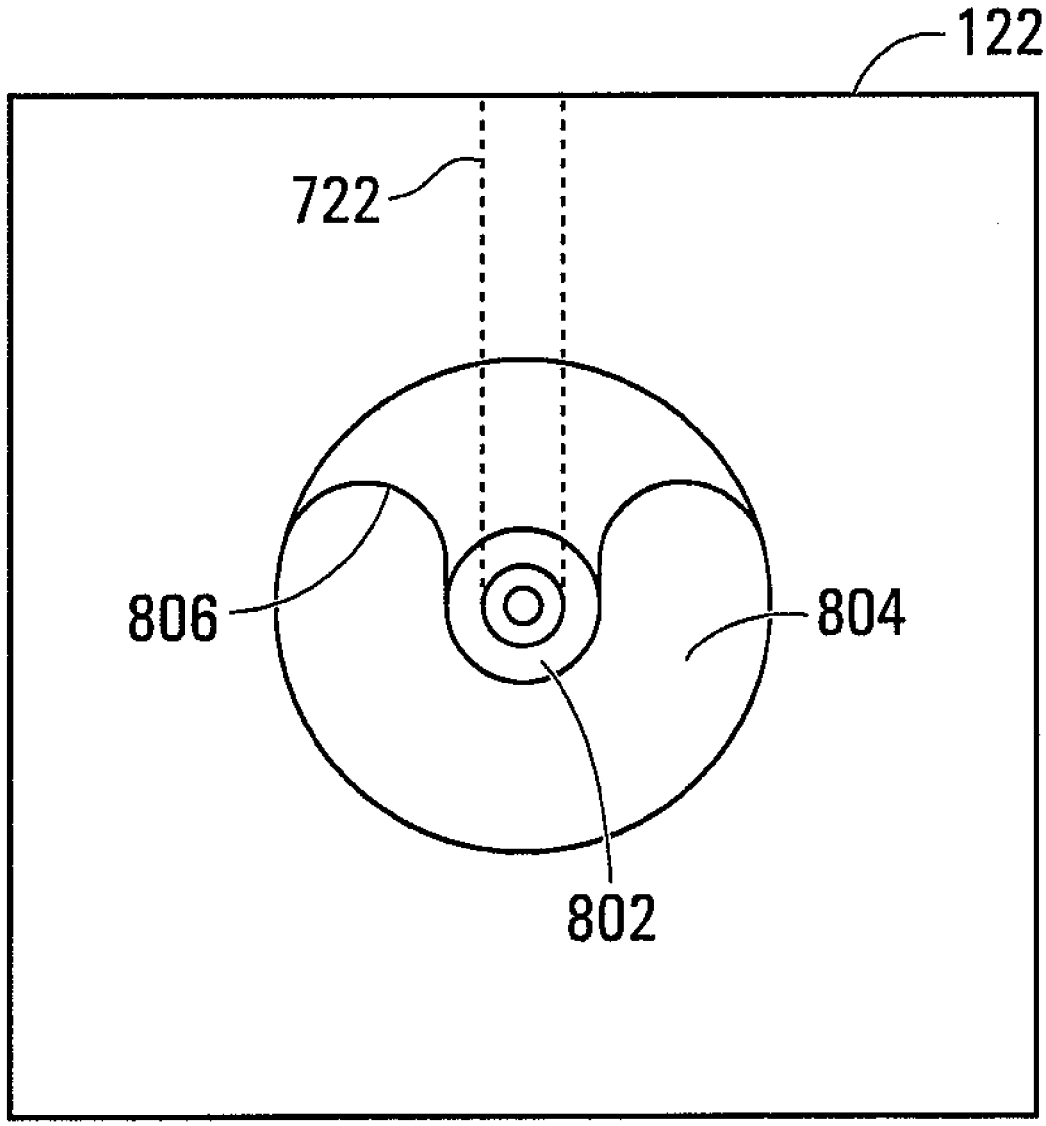
FIG. 8 is an elevation view of a second anode housing member of the anode portion shown in FIG. 7, as viewed from inside an envelope of the apparatus shown in FIG. 1.

Referring to FIGS. 7 and 8, in the present embodiment, the anode 108 is somewhat similar to the cathode 106, although in this embodiment the cathode 106 has a shorter length than the anode 108. More particularly, in this embodiment the anode 108 includes an anode pipe 704, an outer end of which is threaded into an aperture defined through the second anode housing member 122. A seal 706 provides a tight seal between the outer end of the anode pipe 704 and the second anode housing member 122. The anode 108 further includes an anode body 708, which is threaded into a wider portion of the aperture defined through the second anode housing 122, with a seal 710 providing a tight seal between the anode body 708 and the second anode housing 122. The anode pipe 704 is threadedly connected to an anode insert 712, and the anode body 708 is threadedly connected to an anode head 714, to which an anode tip 716 is mounted. The anode body 708 and the anode head 714 surround the anode pipe 704 and the anode insert 712. Again, as with the cathode, if desired, other suitable types of connections, such as soldering or welding, may be substituted for the threaded connections described above if desired.

In this embodiment, the anode pipe 704, the anode body 708, and the anode insert 712 are made of brass, the anode head 714 is made of copper, and the anode tip 716 is made of tungsten. Alternatively, other suitable materials may be substituted if desired. In this embodiment, the tungsten anode tip 716 has a thickness of at least one centimeter. Advantageously, therefore, as discussed earlier herein, the combination of liquid cooling of the anode 108 as described below, and the relatively thick tungsten anode tip 716, tends to provide the anode 108 with a greater lifespan than conventional electrodes.

Figure 13:
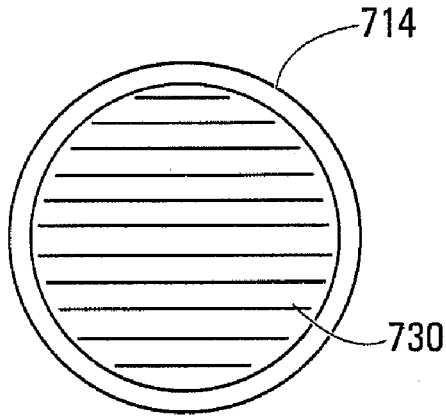
FIG. 13 is a bottom elevation view of an inside surface of the anode tip shown in FIG. 12.
Figure 12:
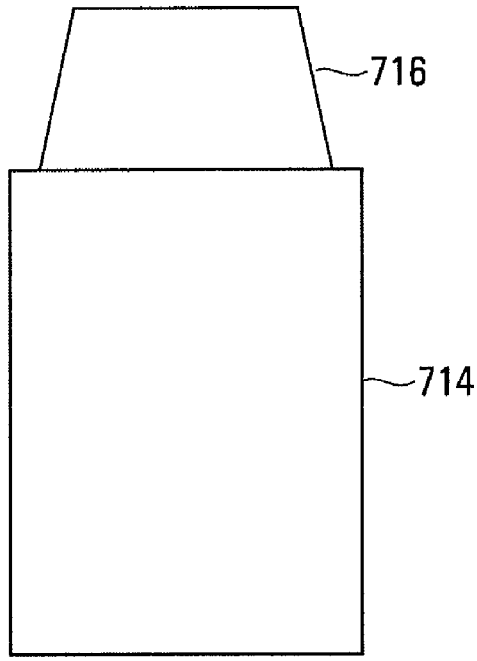
FIG. 12 is a side elevation view of an anode tip of an anode of the anode portion shown in FIG. 7.

Referring to FIGS. 2, 7, 8 and 11-13, to provide the anode 108 with a flow of liquid coolant, in this embodiment the anode side 114 of the apparatus 100 includes a liquid inlet 720 shown in FIG. 7, mounted to the second anode housing 122. The liquid inlet 720 receives pressurized liquid coolant from the liquid outlet port 184 of the separation and purification system 142 shown in FIG. 2. The liquid coolant is conveyed through the liquid inlet 720 into a coolant conduit 722 defined in the second anode housing 122. The coolant conduit 722 conveys the liquid into a space 732 defined between an outside surface of the anode pipe 704 and an inside surface of the anode body 708. A first portion of the pressurized liquid coolant, which travels through a first portion of the space 732 shown in the lower half of FIG. 3, enters a space 728 defined between the anode insert 712 and the anode head 714. As the liquid travels through the space 728, it removes heat from the anode head 714, and hence from the anode tip 716. As shown in FIG. 13, in the present embodiment, an inside surface 730 of the anode head 714 includes a plurality of parallel grooves, for directing the liquid coolant in a desired direction. As shown in FIG. 7, the grooves direct the first portion of the liquid coolant from the space 728 into a second portion of the space 732 shown in the upper half of FIG. 3, in the vicinity of a hole 726 defined through the anode insert 712. A second portion of the pressurized liquid coolant travels directly from the coolant conduit 722 along the second portion of the space 732 to the vicinity of the hole 726. Both portions of the pressurized liquid coolant then pass through the hole 726 and into a coolant channel 724 defined inside the anode pipe 704. The liquid coolant continues to travel outwardly through the coolant channel 724, until it enters the exhaust chamber 110.

Referring to FIGS. 2 and 7-10, in addition to providing a liquid coolant channel as described above, in this embodiment the second anode housing member 122 also provides an electrical connection between the anode 108 and the electrical power supply system 130. In this embodiment, the second anode housing member 122 includes a conductor. More particularly, in this embodiment the second anode housing member 122 is made of brass. The second anode housing member 122 is connected to the positive terminal 134 (which in this embodiment is grounded) of the electrical power supply system 130, via an electrical connector 900 shown in FIGS. 9 and 10. In this embodiment, the electrical connector 900 includes four compression-style lug connectors, although alternatively, other suitable types of electrical connectors may be substituted. Thus, the second anode housing member 122 completes the electrical connection, allowing electrons to flow from the anode tip 716, through the anode head 714 and through the anode body 708, into and through the second anode housing member 122 and its electrical connector 900, to the positive terminal 134 of the electrical power supply system 130.

Figure 9:
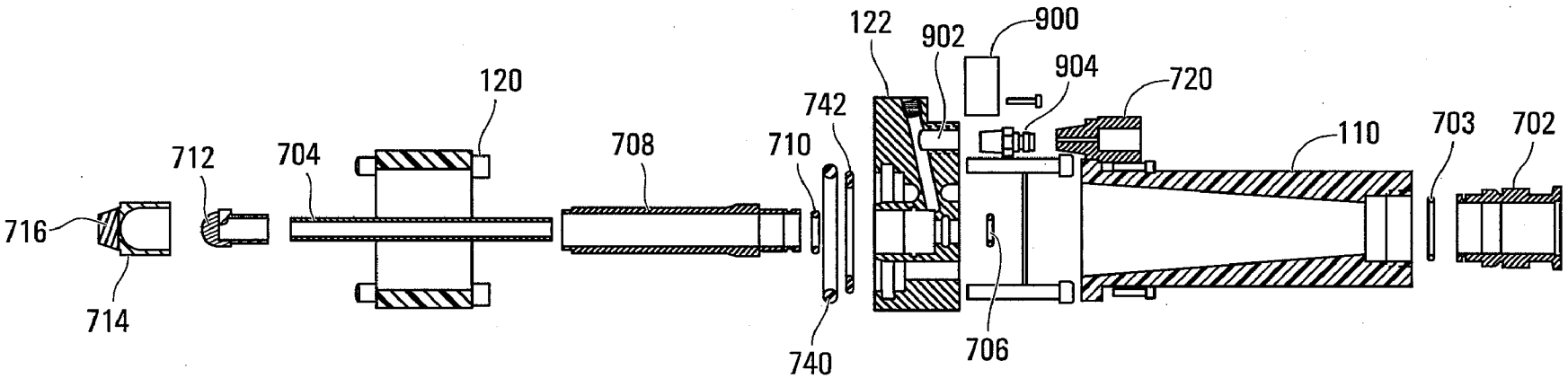
FIG. 9 is an exploded cross-section of the anode portion shown in FIG. 7.
Figure 10:
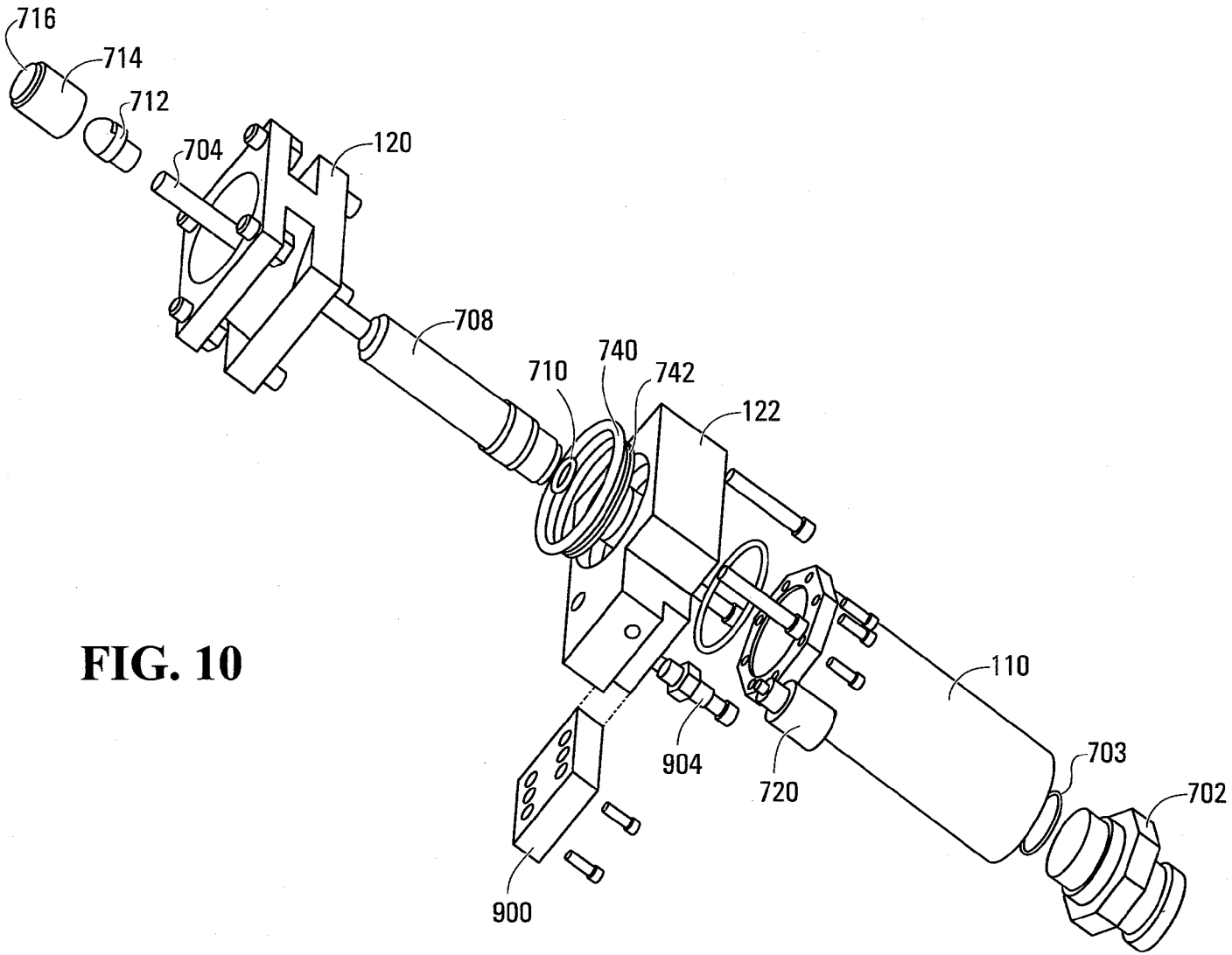
FIG. 10 is an exploded perspective view of the anode portion shown in FIG. 7.
Figure 11:
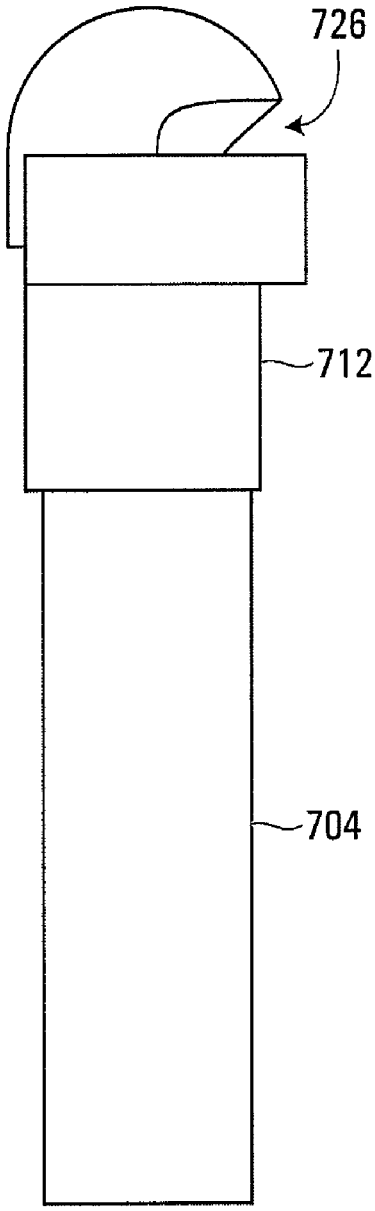
FIG. 11 is a side elevation view of an anode insert of an anode of the anode portion shown in FIG. 7.

Referring to FIGS. 2, 9 and 10, in this embodiment the second anode housing member 122 includes a pressure transducer port 902, for receiving a pressure transducer 904 therein. The pressure transducer is in communication with the controller 170 shown in FIG. 2, to which it transmits a signal indicative of pressure within the envelope 104.

Referring to FIGS. 7 and 9, in this embodiment, the envelope 104 is received through respective apertures in the reflector 116 and the first anode housing member 120, and is snugly received in the second anode housing member 122. A seal 740, which in this embodiment includes an O-ring, provides a tight seal between an outer surface of the envelope 104 and the second anode housing member 122. A washer 742, which in this embodiment includes a Teflon washer, is interposed between an outer end of the envelope 104 and the second anode housing member 122.

Referring to FIGS. 7 and 8, a further view of the second anode housing member 122 is shown in FIG. 8. A central portion 802 of the second anode housing member 122, to which the anode body 708 is connected, is mounted at the center of an aperture 804 defined through the second anode housing member 122. A lip 806 joins the central portion 802 to the remainder of the second anode housing member 122, and supports the central portion 802, and hence the anode 108, within the aperture 804. The coolant conduit 722 extends through the lip 806 to an aperture defined through the central portion 802.

During operation, the vortexing flows of liquid and gas generated by the flow generator 150 shown in FIGS. 2 and 3 travel through the aperture 804, and into the exhaust chamber 110, interrupted only partially by the lip 806. In this regard, the size of the lip 806 is preferably sufficiently large to provide adequate mechanical strength to support the anode 108 against the large mechanical stresses that result during each flash, but is otherwise preferably as small as possible so as to minimize interference with the vortexing flow of liquid on the inside surface 102 of the envelope 104.

In this embodiment, the first anode housing member 120 includes plastic, or more particularly, ULTEM™ plastic. Alternatively, other suitable materials, such as a ceramic for example, may be substituted. In the present embodiment, in which the positive terminal of the electrical power supply to which the second anode housing member 122 is connected is grounded, an insulator is preferred for the first anode housing member 120 in order to eliminate ground loops, but is not required. Thus, alternatively, the first anode housing member may include a conductor if desired.

Reflector

Figure 14:
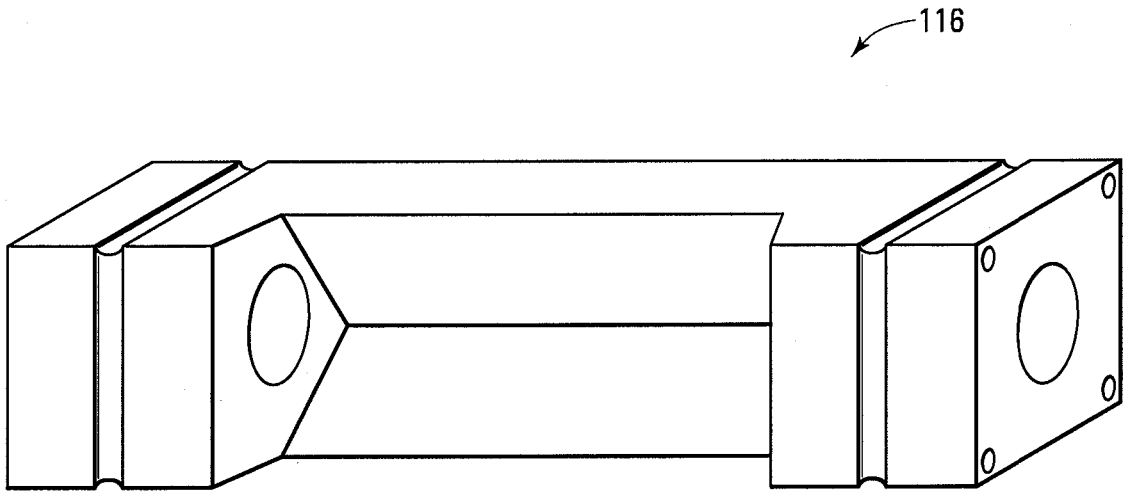
FIG. 14 is a perspective view of a conductive reflector of the apparatus shown in FIG. 1.

Referring to FIGS. 2 and 14, the conductive reflector 116 is shown in greater detail in FIG. 14. In this embodiment, the reflector includes a conductor, or more particularly, aluminum. Alternatively, other suitable materials and configurations may be substituted. As noted, in this embodiment the reflector 116 is grounded. In this embodiment, the reflector extends outside the envelope 104, from a vicinity of the cathode 106 to a vicinity of the anode 108.

Electrical Power Supply

Figure 15:
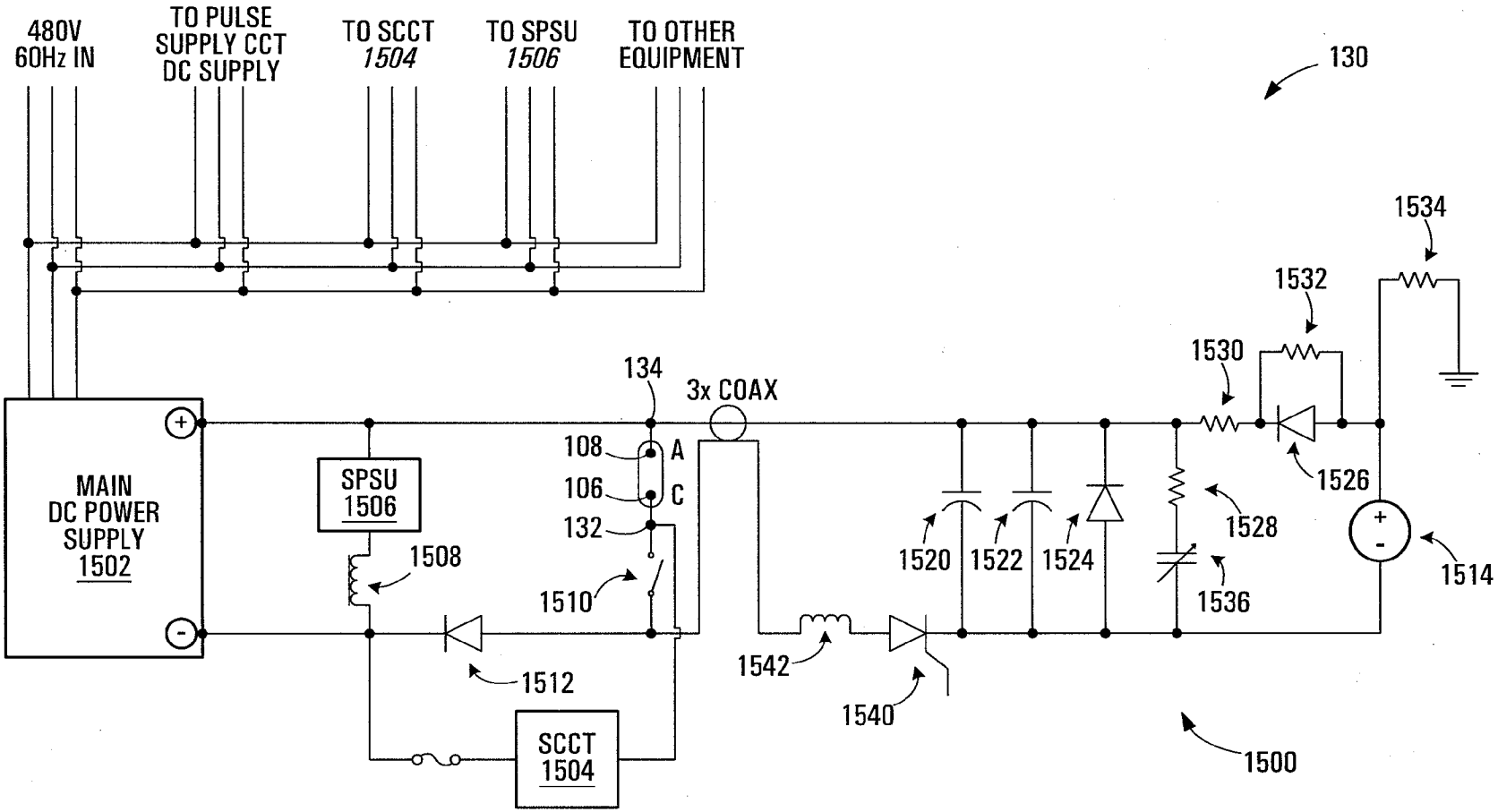
FIG. 15 is a circuit diagram of the electrical power supply shown in FIG. 2.

Referring to FIGS. 2 and 15, the electrical power supply system 130 is shown in greater detail in FIG. 15. In this embodiment, the electrical power supply system 130 includes a plurality of power supply circuits in electrical communication with the electrodes, or more particularly, with the cathode 106 and the anode 108.

More particularly still, in this embodiment the plurality of power supply circuits includes a pulse supply circuit 1500 configured to generate the electrical discharge pulse between the first and second electrodes, an idle current circuit 1502 configured to generate an idle current between the first and second electrodes, a starting circuit 1504 configured to generate a starting current between the first and second electrodes, and a sustaining circuit 1506 configured to generate a sustaining current between the first and second electrodes.

In this embodiment, the power supply system 130 includes at least one isolator configured to isolate at least one of the plurality of power supply circuits from at least one other of the plurality of power supply circuits. More particularly, in this embodiment, a first isolator includes a mechanical switch 1510, which serves to isolate the negative terminals of the idle current circuit 1502 and of the sustaining circuit 1506 from the negative terminal of the starting circuit 1504 when open. Also in this embodiment, a second isolator includes an isolation diode 1512, configured to isolate the idle current circuit 1502 and the sustaining circuit 1506 from the pulse supply circuit 1500. In this embodiment, the mechanical switch 1510 includes a ROSS model GD60-P60-800-2C-40 mechanical switch, and is electrically actuatable in response to a control signal from the controller 170 shown in FIG. 2. In the present embodiment, the isolation diode 1512 includes a 6 $kV_{RRM}$ diode. Alternatively, other suitable isolators may be substituted.

In the present embodiment, the idle current circuit 1502, the starting circuit 1504 and the sustaining circuit 1506 each receive AC power, or more particularly, 480 V, 60 Hz, three-phase power. Similarly, the pulse supply circuit 1500 also includes a DC power supply 1514, which receives similar 480 V/60 Hz power, which it converts to a DC voltage in order to charge capacitors of the pulse supply circuit, as described below. In this embodiment, the DC power supply 1514 is adjustable to produce a desired DC charging voltage up to 4 kV. As shown in FIG. 15, in this embodiment the 480 V/60 Hz AC power is also used to supply other equipment, such as a main pump (not shown) of the fluid circulation system 140 shown in FIG. 2. Similarly, in this embodiment the 480 V/60 Hz power is also supplied to a plurality of transformers, which in turn supply 110 V AC power to the controller 170 shown in FIG. 2, as well as a purifier (not shown) of the fluid circulation system 140. If desired, 220 V power may also be derived from the incoming 480 V power.

In this embodiment, the idle current circuit 1502 rectifies the incoming 480 V AC power, and produces a controllable DC current up to 600 A. In this embodiment, the positive terminal of the idle current circuit 1502 is electrically grounded, and thus, the DC voltage is generated by lowering the electrical potential of the negative terminal relative to the ground.

In the present embodiment, the idle current circuit 1502 is in communication with the controller 170 shown in FIG. 2. When the mechanical switch 1510 is closed, the idle current circuit 1502 receives digital commands received from the controller 170 specifying a desired idle current, in response to which it causes the specified idle current to flow between the cathode 106 and the anode 108 of the apparatus 100. In this embodiment, the idle current circuit 1502 includes a SatCon model HCSR-480-1000 DC power supply circuit, available from SatCon Power Systems of Burlington, Ontario, Canada, a division of SatCon Technology Corporation of Cambridge, Mass., USA. Alternatively, any other suitable type of idle current circuit may be substituted.

In this embodiment, the starting circuit 1504 is used only to initially establish an arc between the cathode 106 and the anode 108. To achieve this, in the present embodiment the starting circuit 1504 receives 480 V/60 Hz AC power, which it rectifies and uses to charge a plurality of internal capacitors (not shown). When its rising internal voltage reaches a predetermined threshold, such as 30 kV for example, the starting circuit 1504 delivers a pulse of current (e.g. 10 A), to establish an arc between the cathode 106 and the anode 108.

In the present embodiment, the sustaining circuit 1506 is used at the time of starting and immediately thereafter, to sustain the arc between the cathode 106 and the anode 108. In this embodiment, the sustaining circuit receives 480 V/60 Hz AC power, which it rectifies to produce a constant current DC output of 15 A. A positive terminal of the sustaining circuit 1506 is in communication with the positive terminal 134 of the power supply system 130, and hence is in communication with the anode 108. A negative terminal of the sustaining circuit 1506 can be placed in electrical communication with the cathode 106 either indirectly through the starting circuit 1504, or directly by closing the mechanical switch 1510, the latter direct connection allowing electrons to flow from the negative terminal of the sustaining circuit 1506, through a magnetic core inductor 1508, through the isolation diode 1512, through the switch 1510, and through the negative terminal 132 of the power supply to the cathode 106. In this embodiment, the magnetic core inductor 1508 has an inductance of 50 millihenrys, although alternatively, other suitable inductances may be substituted In this embodiment, the pulse supply circuit 1500 is used to generate the electrical discharge pulse between the cathode 106 and the anode 108 that produces the desired irradiance flash. To achieve this, the pulse supply circuit 1500 receives 480 V/60 Hz AC power, which is rectified by the DC power supply 1514 to produce a DC voltage, which is used to charge a plurality of capacitors. More particularly, in this embodiment the capacitors include first and second capacitors 1520 and 1522, connected in parallel. In this embodiment, each of the first and second capacitors has a capacitance of 7900 μF, although alternatively, other suitable capacitors may be substituted. In this embodiment, the pulse supply circuit 1500 further includes diodes 1524 and 1526, resistors 1528, 1530, 1532 and 1534, and a dump relay 1536, all configured as shown in FIG. 15. In this embodiment, the resistors 1528, 1530, 1532 and 1534 have resistances of 60 Ω, 5Ω, 20 kΩ and 20 kΩ respectively.

In this embodiment, to discharge the capacitors and generate the electrical discharge pulse when desired, the pulse supply circuit 1500 includes a discharge switch. More particularly, in this embodiment the discharge switch includes a silicon-controlled rectifier (SCR) 1540, in communication with the controller 170 shown in FIG. 2. As will be appreciated, the SCR 1540 will not conduct until a gate voltage is applied to the SCR 1540 by the controller 170, in response to which the SCR 1540 will begin conducting and will continue to conduct as long as the current flowing across it exceeds the intrinsic holding current of the SCR. Thus, the SCR 1540 does not allow the capacitors of the pulse supply circuit 1500 to discharge until the gate voltage is applied to the SCR 1540 by the controller 170, in response to which the capacitors of the pulse supply circuit are allowed to discharge. In this embodiment the discharge occurs through an inductor 1542, which in the present embodiment has an inductance of 4.6 microhenrys. Alternatively, other suitable types of discharge switches may be substituted.

Operation

Referring to FIGS. 2 and 15, in this embodiment, the controller 170, or more particularly the processor circuit 172 thereof, is configured by a routine including executable instruction codes stored in the computer-readable medium 174, to communicate with the relevant components of the fluid circulation system 140 and the electrical supply system 130, to use the apparatus 100 to produce an irradiance flash, as described in greater detail below.

The processor circuit 172 is first directed to signal the fluid circulation system 140 to begin circulating liquid and gas through the apparatus, to generate the vortexing flows of liquid and gas, as described in greater detail above in connection with FIGS. 3-5. In this embodiment, the vortexing flow of liquid is delivered to the liquid vortex generator 324 at a pressure on the order of about 17-20 atmospheres. Advantageously, such high pressures tend to reduce the likelihood of envelope exposure during the resulting flash.

The processor circuit 172 is then directed to communicate with various components of the electrical power supply system 130, to cause such components to execute a sequence of starting an arc between the cathode 106 and the anode 108, sustaining the arc, preceding the flash with an idle current, then generating the electrical discharge pulse to produce the irradiance flash.

More particularly, at initial start-up, the mechanical switch 1510 is in an open position. The processor circuit 172 is directed to send start-up signals to the starting circuit 1504, the sustaining circuit 1506, and the pulse supply circuit 1500, to turn each of these devices on. Thus, the capacitors within the starting circuit 1504 and the pulse supply circuit 1500 begin to charge. The sustaining circuit 1506 does not produce enough voltage to establish an arc between the cathode 106 and the anode 108, and is therefore not needed until after an arc has been established. The idle current supply 1502 is not yet producing current, and is awaiting receipt of an appropriate control signal from the processor circuit 172.

As soon as the internal capacitors in the starting circuit 1504 have reached a threshold voltage for arc breakdown (establishment), in this embodiment up to 30 kV, the capacitors then deliver up to 10 amps of current to establish an arc between the cathode 106 and the anode 108. As soon as the arc is established, the sustaining circuit 1506 is able to deliver a 15 A sustaining current indirectly through the starting circuit 1504 to sustain the arc. A current sensor (not shown) of the apparatus 100 signals the processor circuit 172 to indicate that a stable arc has been established. Upon receipt of such a signal, the processor circuit 172 is directed to signal the starting circuit 1504 to turn itself off, and is further directed to send a control signal to an electrical actuator of the mechanical switch 1510, to cause the mechanical switch to close, thereby allowing the sustaining circuit 1506 to bypass the starting circuit 1504. In other words, the closure of the switch 1510 places the negative terminal of the sustaining circuit 1506 in communication with the cathode 106, via the magnetic core inductor 1508, the isolation diode 1512 and the switch 1510. Thus, when the switch 1510 has been closed, the sustaining circuit 1506 continues to cause a 15 A sustaining current to flow between the cathode 106 and the anode 108.

When a flash is desired, the processor circuit 172 of the controller 170 is directed to first signal the idle current circuit 1502 to supply a suitable idle current, following which the controller signals the pulse supply circuit 1500 to generate the electrical discharge pulse.

More particularly, in the present embodiment the idle current circuit 1502 is configured to generate the idle current for a time period preceding the electrical discharge pulse, the time period being longer than a fluid transit time required by the flow of liquid to travel through the envelope 104. Thus, in the present embodiment, in which the fluid transit time is on the order of thirty milliseconds, the idle current circuit is configured to generate the idle current for at least 30 ms.

As discussed earlier herein, in the present embodiment the idle current circuit 1502 is configured to generate a much larger idle current than conventional flashlamps, in which the idle currents are typically 1 A or less. As discussed earlier herein, such high idle currents are advantageous, as they significantly improve the consistency and reproducibility of the resulting irradiance flash.

More particularly, in this embodiment the idle current circuit is configured to generate an idle current of at least about 100 amps.

More particularly still, in this embodiment the idle current circuit is configured to effectively generate an idle current of at least about 400 A, for a duration of at least about 100 ms. To achieve this, in the present embodiment the processor circuit 172 is directed to send a digital signal to the idle current circuit 1502, specifying a desired current output of 385 A. In response to the digital signal, the idle current circuit 1502 begins applying the specified current of 385 A, which when added to the 15 A being supplied by the sustaining circuit 1506 yields the desired 400 A current between the cathode 106 and the anode 108.

Approximately 100 ms later, the processor circuit 172 is directed to apply a gate voltage to the SCR 1540, thereby allowing the capacitors of the pulse supply circuit 1500 to discharge through the inductor 1542 and the closed mechanical switch 1510, thereby generating the desired electrical discharge pulse between the cathode 106 and the anode 108 and thus producing the desired irradiance flash. In this embodiment, the radiant energy output of the apparatus 100 during the flash is on the order of 50 kJ.

As the pulse supply circuit 1500 discharges in the above manner, the isolation diode 1512 protects the sustaining circuit 1506 and the idle current circuit 1502 from the discharge from the pulse supply circuit. The starting circuit 1504, which is a high voltage device, does not require protection from this discharge, as at this point in time, the starting circuit 1504 is turned off, and is also protected by the mechanical switch 1510.

Approximately simultaneously with the application of the gate voltage to the SCR 1540 to produce the flash, the processor circuit is further directed to send a control signal to the disposal valve 160, to cause the disposal valve to close the recirculation outlet port 164 and open the disposal outlet port 166, to begin disposing of the liquid and gas within the envelope 104 at the time of the flash. The processor circuit 172 is further directed to signal the separation and purification system 142 to begin receiving replenishment liquid and gas via the liquid replenishment input port 190 and the gas replenishment input port 192, to replace the liquid and gas ejected via the disposal outlet port 166. A short time later (in this embodiment, approximately 100 ms, which is significantly longer than a typical fluid transit time across the envelope 104), the processor circuit 172 is directed to signal the disposal valve to re-open the recirculation outlet port 164 and close the disposal outlet port 166, and is similarly directed to signal the separation and purification system 142 to close the liquid and gas replenishment input ports 190 and 192. Thus, substantially all of the liquid that was in the envelope 104 at the time of the flash, which is potentially contaminated with fine particulate matter, is disposed of, while retaining the remainder of the liquid and gas from the system for recirculation.

In this embodiment, continuous or DC operation of the apparatus 100 occurs in a somewhat similar manner, although the pulse supply circuit 1500 is not required. The starting circuit 1504 and the sustaining circuit 1506 co-operate to establish and sustain an arc as discussed above. The idle current circuit 1502 may then be used as a main DC power supply circuit for continuous operation of the apparatus 100. As discussed above, the controller 170 transmits a digital signal to the idle current circuit 1502, specifying a desired current output. The combined current outputs of the idle current circuit 1502 and the sustaining circuit 1504 are supplied between the cathode 106 and the anode 108, to generate a desired continuous current, thus producing a desired continuous irradiance power output.

Alternatives

Although the apparatus 100 described herein is capable of dual operation as either a flashlamp or a continuous arc lamp, alternatively, embodiments of the invention may be customized or specialized for one of these applications, if desired.

Although the foregoing embodiment involves a single water-wall flowing on the inside surface 102 of the envelope 104, alternatively, the present invention may be embodied in a double-liquid-wall arc lamp, such as that disclosed in the aforementioned commonly-owned U.S. Pat. No. 6,621,199, for example, to adapt the double-liquid-wall arc lamp for use as a flashlamp as described herein.

Figure 16:
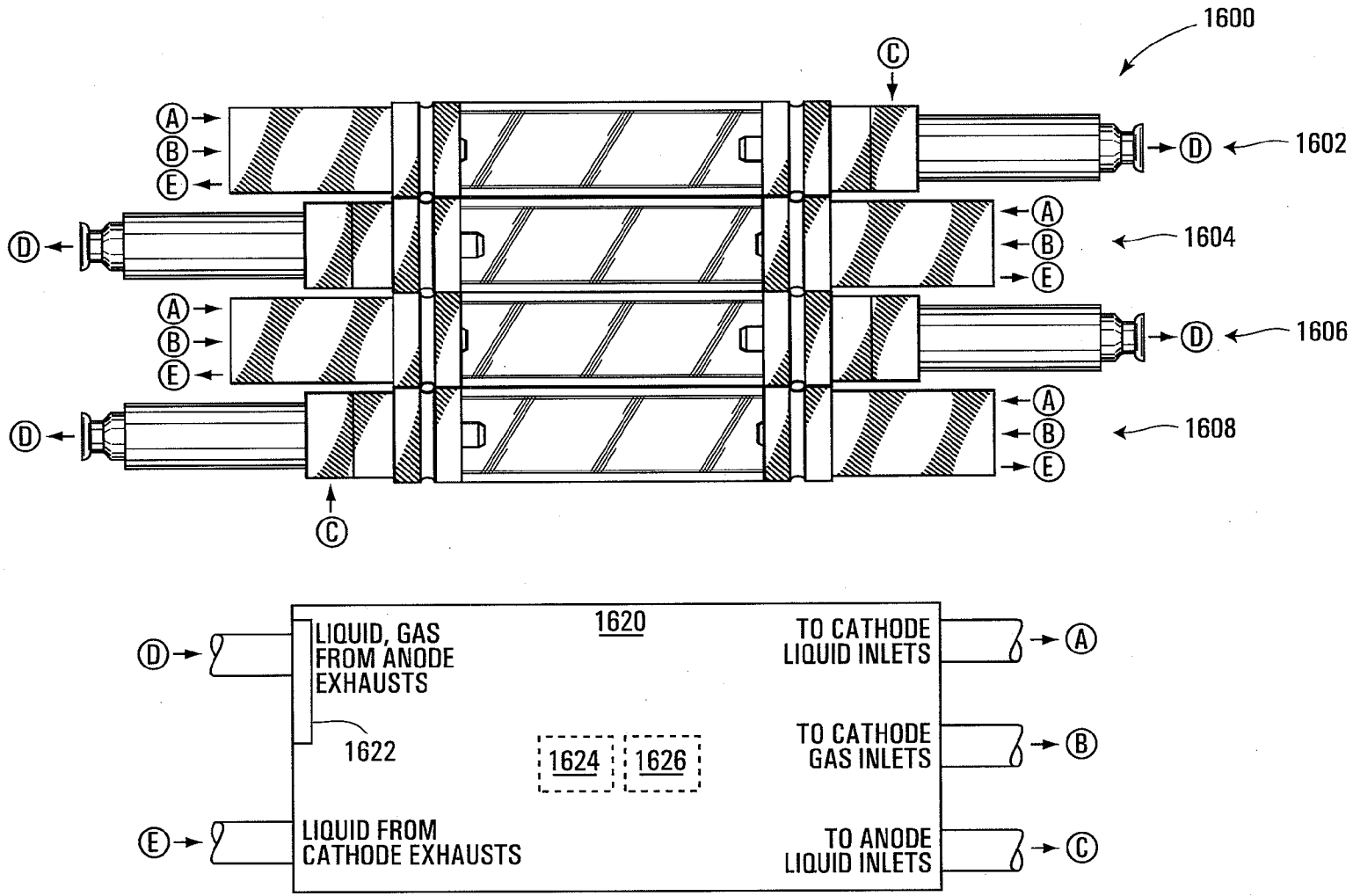
FIG. 16 is a front elevation view of a system for producing an irradiance flash, including a plurality of apparatuses similar to those shown in FIG. 1 and a single fluid circulation device.

Referring to FIGS. 2 and 16, a system including a plurality of apparatuses similar to the apparatus 100 is shown generally at 1600 in FIG. 16. More particularly, in this embodiment the system 1600 includes first, second, third and fourth apparatuses 1602, 1604, 1606 and 1608, each similar to the apparatus 100 shown in FIG. 2. The apparatuses 1602, 1604, 1606 and 1608 are configured to produce a plurality of respective irradiance flashes incident upon a common target.

In this embodiment, the apparatuses 1602, 1604, 1606 and 1608 are configured parallel to each other. More particularly, in the present embodiment, each one of the apparatuses 1602, 1604, 1606 and 1608 is aligned in a direction opposite to an adjacent one of the plurality of apparatuses. Thus, in this embodiment, a cathode of the each one of the plurality of apparatuses is adjacent an anode of the adjacent one of the plurality of apparatuses. Advantageously, therefore, if the apparatuses 1602, 1604, 1606 and 1608 are used to produce simultaneous flashes, the large magnetic fields resulting from the electrical discharge pulses of the four lamps tend to largely cancel each other out.

In the present embodiment, the electrical insulation surrounding the flow generators, the cathodes, and the electrical connections thereto, allow close spacing of adjacent apparatuses. Thus, in this embodiment, an axial line between the first and second electrodes of each one of the plurality of apparatuses 1602, 1604, 1606 and 1608 is spaced apart less than 10 centimeters from an axial line between the first and second electrodes of an adjacent one of the plurality of apparatuses.

In this embodiment, the system 1600 further includes a single circulation device 1620, configured to supply liquid to the flow generator of each of the plurality of apparatuses. The circulation device 1620 is generally similar to the fluid circulation system 140 shown in FIG. 2, and incorporates a disposal valve 1622 similar to the disposal valve 160 shown in FIG. 2. In this embodiment, the single circulation device 1620 is configured to receive liquid and gas from an exhaust port of each of the plurality of apparatuses, and includes a separator 1624 configured to separate the liquid from the gas. Likewise, in this embodiment the single circulation device 1620 includes a filter 1626 for removing particulate contamination from the liquid, which in this embodiment is similar to the filter 144 shown in FIG. 2. Similarly, in this embodiment the single circulation device 1620 includes additional inlet and outlet ports not shown in FIG. 16, including a disposal outlet port, a gas replenishment inlet port, and a liquid replenishment inlet port, similar to those described in connection with FIG. 2. As in the previous embodiment, the liquid received by the circulation device 1620 via the liquid replenishment inlet port includes purified, highly insulative low conductivity water. Thus, in this embodiment, the single circulation device 1620 is configured to supply to the flow generator of each of the apparatuses, water having a conductivity of less than about ten micro-Siemens per centimeter.

If desired, the apparatuses 1602, 1604, 1606 and 1608 may be configured to produce the plurality of respective irradiance flashes incident upon a semiconductor wafer. Thus, for example, the system 1600 may be substituted for the flashlamps disclosed in commonly-owned U.S. Pat. No. 6,594,446 or in commonly-owned U.S. patent application publication no. US 2002/0102098 A1, to rapidly heat the device side of the semiconductor wafer to a desired annealing temperature. The flashes produced by the lamps may be simultaneous, if desired.

Or, referring back to FIG. 2, rather than substituting the system 1600, a single apparatus 100 may be substituted for the flashlamps disclosed in the aforementioned commonly-owned U.S. Pat. No. 6,594,446 or publication no. US 2002/0102098 A1, if desired.

Similarly, if desired, a plurality of apparatuses similar to the apparatus 100 may be arranged as shown in FIG. 16, but may be operated with continuous DC currents to supply a continuous radiant output. Such a combination of apparatuses, or alternatively, a single apparatus 100, may be substituted for the continuous arc lamp used as a pre-heating device in the aforementioned commonly-owned U.S. Pat. No. 6,594,446 or publication no. US 2002/0102098 A1, if desired.

More generally, while specific embodiments of the invention have been described and illustrated, such embodiments should be considered illustrative of the invention only and not as limiting the invention as construed in accordance with the accompanying claims.

What is claimed is:

1. An apparatus for producing electromagnetic radiation, the apparatus comprising a water-wall arc lamp, the water-wall arc lamp comprising:

a) a flow generator configured to generate a flow of liquid along an inside surface of an envelope;

b) first and second electrodes configured to generate an electrical arc within the envelope to produce the electromagnetic radiation; and c) an exhaust chamber extending outwardly beyond one of said electrodes, configured to accommodate a portion of said flow of liquid, wherein said exhaust chamber extends axially outwardly sufficiently far beyond said one of said electrodes to isolate said one of said electrodes from turbulence resulting from collapse of said flow of liquid within said exhaust chamber.

2. The apparatus of claim 1 wherein said flow generator is configured to generate a flow of gas radially inward from said flow of liquid, and wherein said exhaust chamber extends sufficiently far beyond said one of said electrodes to isolate said one of said electrodes from turbulence resulting from mixture of said flows of liquid and gas.

3. The apparatus of claim 1 wherein said electrodes are configured to generate an electrical discharge pulse to produce an irradiance flash, and wherein said exhaust chamber has a sufficient volume to accommodate a volume of said liquid forced outward by a pressure pulse resulting from said electrical discharge pulse.

4. The apparatus of claim 3, further comprising a disposal valve in fluid communication with and downstream of the exhaust chamber, wherein the disposal valve is operable to dispose of the flow of liquid received from the exhaust chamber for at least a fluid transit time required by the flow of liquid to travel through the envelope.

5. The apparatus of claim 1 wherein said second electrode comprises an anode, and wherein said exhaust chamber extends axially outwardly beyond said anode.

6. The apparatus of claim 1 wherein said flow generator is electrically insulated.

7. The apparatus of claim 6 further comprising electrical insulation surrounding said flow generator.

8. The apparatus of claim 7 wherein said flow generator comprises a conductor.

9. The apparatus of claim 7 wherein said first electrode comprises a cathode, and wherein said electrical insulation surrounds said cathode and an electrical connection thereto.

10. The apparatus of claim 9 further comprising said electrical connection, and wherein said electrical connection comprises said flow generator.

11. The apparatus of claim 7 wherein said electrical insulation surrounding said flow generator comprises said envelope.

12. The apparatus of claim 11 wherein said electrical insulation surrounding said flow generator further comprises an insulative housing.

13. The apparatus of claim 12 wherein said insulative housing surrounds at least a portion of said envelope.

14. The apparatus of claim 13 wherein said electrical insulation further comprises compressed gas in a space between said insulative housing and said portion of said envelope.

15. The apparatus of claim 12 wherein said insulative housing comprises at least one of a plastic and a ceramic.

16. The apparatus of claim 11 wherein said envelope comprises a transparent cylindrical tube.

17. The apparatus of claim 16 wherein said tube has a thickness of at least four millimeters.

18. The apparatus of claim 16 wherein said tube comprises a precision bore cylindrical tube.

19. The apparatus of claim 6 wherein said first and second electrodes comprise a cathode and an anode, said cathode having a shorter length than said anode.

20. The apparatus of claim 6 wherein said first electrode comprises a cathode having a protrusion length along which it protrudes axially inwardly within the envelope toward a center of the apparatus beyond an adjacent component of the apparatus within the envelope, and wherein said protrusion length is less than double a diameter of said cathode.

21. The apparatus of claim 20 wherein said adjacent component comprises said flow generator, and wherein said protrusion length is sufficiently long to prevent said electrical arc from occurring between said flow generator and said second electrode.

22. A system comprising a plurality of apparatuses as defined by claim 6, configured to irradiate a common target.

23. The system of claim 22 wherein said plurality of apparatuses are configured to irradiate a semiconductor wafer.

24. The system of claim 22 wherein said plurality of apparatuses are configured parallel to each other.

25. The system of claim 24 wherein each one of said plurality of apparatuses is aligned in a direction opposite to an adjacent one of said plurality of apparatuses, such that a cathode of said each one of said plurality of apparatuses is adjacent an anode of said adjacent one of said plurality of apparatuses.

26. The system of claim 22 further comprising a single circulation device configured to supply liquid to said flow generator of each of said plurality of apparatuses.

27. The apparatus of claim 6 further comprising a conductive reflector outside said envelope and extending from a vicinity of said first electrode to a vicinity of said second electrode.

28. The apparatus of claim 6 further comprising a plurality of power supply circuits in electrical communication with said electrodes.

29. The apparatus of claim 28 further comprising an isolator configured to isolate at least one of said plurality of power supply circuits from at least one other of said plurality of power supply circuits.

30. The apparatus of claim 6 wherein each of said electrodes comprises a coolant channel for receiving a flow of coolant therethrough.

31. The apparatus of claim 30 wherein at least one of said electrodes comprises a tungsten tip having a thickness of at least one centimeter.

32. The apparatus of claim 30 wherein said electrodes are configured to generate an electrical discharge pulse to produce an irradiance flash, and further comprising an idle current circuit configured to generate an idle current between said first and second electrodes.

33. The apparatus of claim 32 wherein said idle current circuit is configured to generate said idle current for a time period preceding said electrical discharge pulse, said time period being longer than a fluid transit time required by said flow of liquid to travel through said envelope.

34. The apparatus of claim 32 wherein said idle current circuit is configured to generate, as said idle current, a current of at least about 1×102 amps.

35. The apparatus of claim 32 wherein said idle current circuit is configured to generate, as said idle current, a current of at least about 4×102 amps, for at least about 1×102 milliseconds.

36. An apparatus for producing electromagnetic radiation, the apparatus comprising:

a) means for generating a flow of liquid along an inside surface of an envelope of a water-wall arc lamp;

b) means for generating an electrical arc within the envelope to produce the electromagnetic radiation; and c) means for accommodating a portion of said flow of liquid, said means for accommodating extending outwardly beyond said means for generating, wherein said means for accommodating comprises means for isolating said one of said electrodes from turbulence resulting from collapse of said flow of liquid within said means for accommodating.

37. The apparatus of claim 36 further comprising means for generating a flow of gas radially inward from said flow of liquid, and wherein said means for accommodating comprises means for isolating said one of said electrodes from turbulence resulting from collapse of said flows of liquid and gas.

38. The apparatus of claim 36 wherein said means for generating an electrical arc comprises means for generating an electrical discharge pulse to produce an irradiance flash, and wherein said means for accommodating comprises accommodating a volume of said liquid forced outward by a pressure pulse resulting from said electrical discharge pulse.

39. A method of producing electromagnetic radiation, the method comprising:

a) generating a flow of liquid along an inside surface of an envelope of a water-wall arc lamp;

b) generating an electrical arc within the envelope between first and second electrodes to produce the electromagnetic radiation; and c) accommodating a portion of said flow of liquid in an exhaust chamber extending outwardly beyond one of said electrodes, wherein accommodating the portion of said flow of liquid comprises isolating said one of said electrodes from turbulence resulting from collapse of said flow of liquid within said exhaust chamber.

40. The method of claim 39 further comprising generating a flow of gas radially inward from said flow of liquid, and wherein accommodating the portion of said flow of liquid comprises isolating said one of said electrodes from turbulence resulting from collapse of said flows of liquid and gas.

41. The method of claim 39 wherein generating the electrical arc comprises generating an electrical discharge pulse to produce an irradiance flash, and wherein accommodating the portion of said flow of liquid comprises accommodating a volume of said liquid forced outward by a pressure pulse resulting from said electrical discharge pulse.

42. The method of claim 41, further comprising disposing of the flow of liquid received from the exhaust chamber for at least a fluid transit time required by the flow of liquid to travel through the envelope.

43. The method of claim 39 wherein generating the flow of liquid comprises generating the flow of liquid using an electrically insulated flow generator.

44. A method comprising controlling a plurality of apparatuses as defined by claim 43 to irradiate a common target.

45. The method of claim 44 wherein controlling the plurality of apparatuses comprises controlling the plurality of apparatuses to irradiate a semiconductor wafer.

46. The method of claim 44 wherein controlling the plurality of apparatuses comprises causing each one of said plurality of apparatuses to generate said electrical arc in a direction opposite to that of an electrical arc direction in each adjacent one of said plurality of apparatuses.

47. The method of claim 43 further comprising isolating at least one of a plurality of power supply circuits from at least one other of said plurality of power supply circuits.

48. The method of claim 43 further comprising cooling said first and second electrodes.

49. The method of claim 48 wherein cooling comprises circulating liquid coolant through respective coolant channels of said first and second electrodes.

50. The method of claim 48 wherein generating said electrical arc comprises generating an electrical discharge pulse to produce an irradiance flash, and further comprising generating an idle current between said first and second electrodes.

51. The method of claim 50 wherein generating said idle current comprises generating said idle current for a time period preceding said electrical discharge pulse, said time period being longer than a fluid transit time required by said flow of liquid to travel through said envelope.

52. The method of claim 50 wherein generating said idle current comprises generating, as said idle current, a current of at least about 1×102 amps.

53. The method of claim 50 wherein generating said idle current comprises generating, as said idle current, a current of at least about 4×102 amps, for at least about 1×102 milliseconds.

* * * * *